US011568847B2

(12) United States Patent
Perdue

(10) Patent No.: US 11,568,847 B2
(45) Date of Patent: Jan. 31, 2023

(54) FULL FREQUENCY ACOUSTIC SYSTEM AND METHOD OF USE

(71) Applicant: JayVic LLC, Amarillo, TX (US)

(72) Inventor: Joab Jay Perdue, Amarillo, TX (US)

( * ) Notice: Subject to any disclaimer, the term of this patent is extended or adjusted under 35 U.S.C. 154(b) by 0 days.

(21) Appl. No.: 17/590,740

(22) Filed: Feb. 1, 2022

(65) Prior Publication Data

US 2022/0246127 A1 Aug. 4, 2022

Related U.S. Application Data

(60) Provisional application No. 63/144,060, filed on Feb. 1, 2021, provisional application No. 63/144,039, filed on Feb. 1, 2021.

(51) Int. Cl.
*G10K 11/162* (2006.01)

(52) U.S. Cl.
CPC ..... *G10K 11/162* (2013.01)

(58) Field of Classification Search
CPC ..... E04B 1/8209; E04B 1/8227; E04B 1/99; E04B 2001/8423; E04B 2001/8452; G10K 11/162
See application file for complete search history.

(56) References Cited

U.S. PATENT DOCUMENTS 2,160,638 A * 5/1939 Bedell ..... E04B 9/34 181/295
2,753,440 A * 7/1956 Wakefield ..... F21S 8/02 52/145
2,886,859 A * 5/1959 Siering ..... E04B 9/34 181/207
2,897,908 A * 8/1959 Barshefsky ..... E04B 1/84 52/145
3,857,459 A * 12/1974 Adams ..... E04B 1/8209 181/295
4,207,964 A * 6/1980 Taguchi ..... E04B 1/99 428/33
4,227,355 A * 10/1980 Wendt ..... E04H 1/1238 52/64
5,141,073 A * 8/1992 Pelonis ..... E04B 1/8209 181/295
5,623,130 A * 4/1997 Noxon ..... E04B 1/99 181/30

(Continued)

FOREIGN PATENT DOCUMENTS

DE 19739432 A1 * 3/1998 ..... E04B 1/86
DE 19754107 C1 * 2/1999 ..... E04B 1/8209

(Continued)

*Primary Examiner* — Jeremy A Luks
(74) *Attorney, Agent, or Firm* — Shannon Warren

(57) ABSTRACT

An absorbing system for disrupting short and long sound energy wavelengths. The absorbing system comprises a two hanging bars, a plurality of hanging straps, a suspended mass assembly. The suspended mass assembly hangs from the two hanging bars with the plurality of hanging straps. The suspended mass assembly comprises a suspended absorbing mass. The suspended absorbing mass comprises a cover and an absorptive portion. The cover encases and holds the absorptive portion. The suspended absorbing mass comprises a plurality of depths between a top point and a bottom point. The plurality of depths comprise a minimum depth and a maximum depth.

20 Claims, 26 Drawing Sheets

(56) References Cited

U.S. PATENT DOCUMENTS

| | | | | | |
|---|---|---|---|---|---|
| 5,992,561 | A * | 11/1999 | Holben | E04B 1/86 | 181/295 |
| 7,178,630 | B1 * | 2/2007 | Perdue | E04B 1/8209 | 181/290 |
| 8,839,842 | B2 * | 9/2014 | Ashelin | E04B 2/74 | 160/40 |
| 9,038,344 | B2 * | 5/2015 | Mayer | E04B 9/04 | 52/39 |

FOREIGN PATENT DOCUMENTS

| | | | | | |
|---|---|---|---|---|---|
| FR | 2738074 | A3 * | 2/1997 | E04B 1/8209 | |
| WO | WO-2008088251 | A1 * | 7/2008 | E04B 1/8209 | |

* cited by examiner

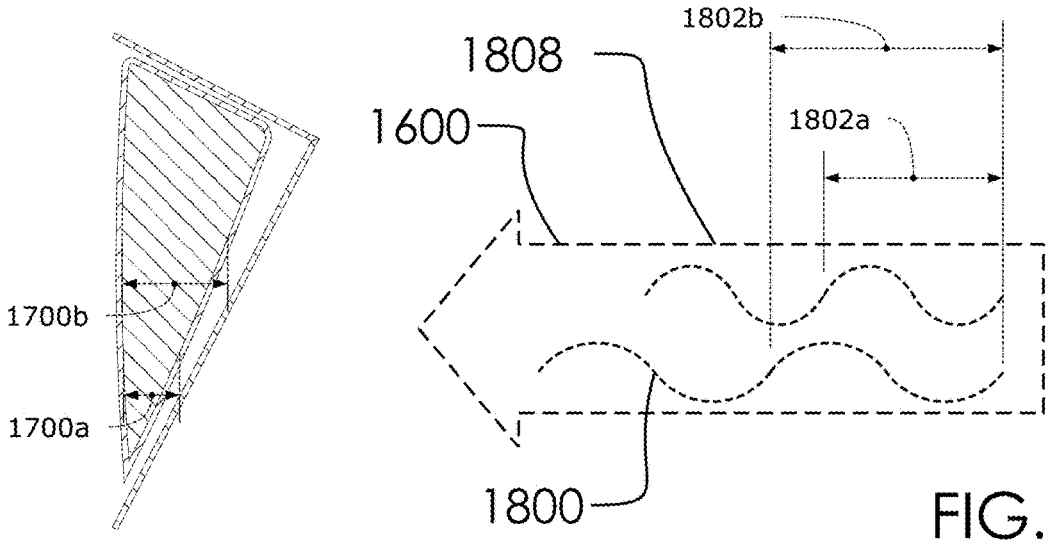
FIG. 18A
1804
| Hertz | Wavelength (ft) | Thickness at one tenth ratio (in) |
|---|---|---|
| 63 | 17.24 | 20.69 |
| 125 | 8.69 | 10.43 |
| 250 | 4.35 | 5.21 |
| 500 | 2.17 | 2.61 |
| 1000 | 1.09 | 1.30 |
| 2000 | 0.54 | 0.65 |
| 4000 | 0.27 | 0.33 |
FIG. 18B
1806
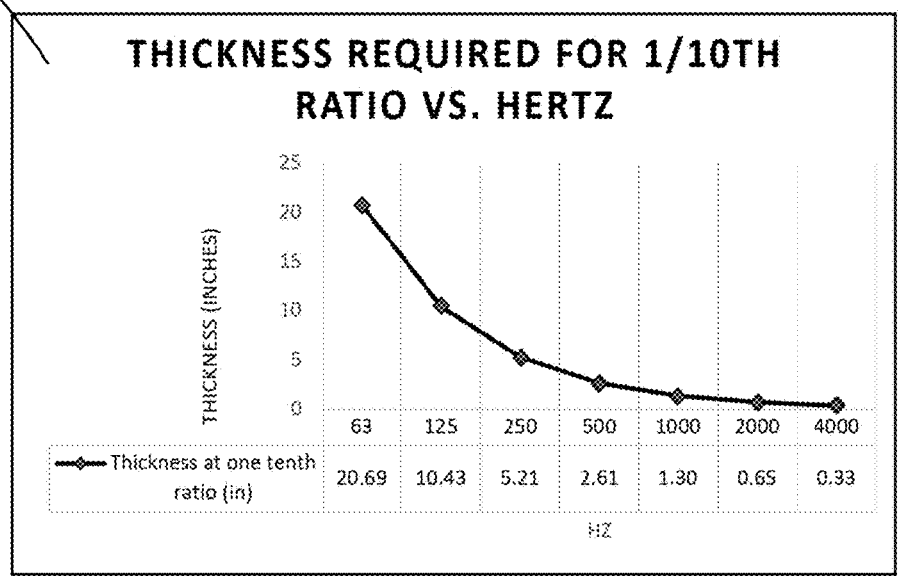
FIG. 18C

1900

| | 63 Hz | 125 Hz | 250 Hz | 500 Hz | 1000 Hz | 2000 Hz | 4000 Hz |
|---|---|---|---|---|---|---|---|
| Internal Limp Mass | 2.37 | 2.6 | 2.54 | 2.8 | 2.75 | 2.61 | |
| Reinforced rockwood 180 degree half round | | 1.87 | 1.64 | 2.46 | 2.59 | 2.33 | 2.32 |
| Reinforced rockwood mega w edge | | 1.42 | 1.61 | 2.19 | 2.13 | 1.89 | 1.75 |
| Reinforced Rockwood 2" | | 0.31 | 1.05 | 1.67 | 1.5 | 1.37 | 1.3 |
| Fiberglass 2" | | 0.2 | 0.71 | 0.89 | 1.08 | 1.08 | 1.04 |
| Fiberglass 1" | | 0.1 | 0.43 | 0.71 | 0.87 | 1.01 | 1 |

100

| Absorber | NRC |
|---|---|
| Internal Limp Mass | 2.72 |
| Reinforced rockwood 180 degree half round | 2.25 |
| Reinforced rockwood mega w edge | 1.95 |
| Reinforced Rockwood 2" | 1.4 |
| Fiberglass 2" | 0.95 |
| Fiberglass 1" | 0.75 |

1902

2300 thicker boards ← → thinner

| Frequency: | | | | | | |
|---|---|---|---|---|---|---|
| Low | 1,305.389 | 1,198.617 | 1,273.956 | 1,271.374 | 1,283.379 | [illegible] |
| | 1,671.708 | 1,503.705 | 1,523.274 | 1,534.260 | 1,502.228 | [illegible] |
| | 1,419.830 | 1,455.527 | 1,483.462 | 1,452.548 | 1,437.777 | [illegible] |
| | 1,399.530 | 1,405.358 | 1,428.542 | 1,389.987 | 1,413.887 | [illegible] |
| | 1,083.065 | 1,092.377 | 1,135.212 | 1,123.480 | 1,078.650 | [illegible] |
| | 859.056 | 875.778 | 887.720 | 846.205 | 883.488 | [illegible] |
| | 685.332 | 671.252 | 699.971 | 693.565 | 690.921 | [illegible] |
| | 532.024 | 544.820 | 538.221 | 503.059 | 546.115 | [illegible] |
| High | 459.129 | 447.532 | 456.010 | 449.660 | 458.117 | [illegible] |
| | | | | | | Average |

FIG. 23

FULL FREQUENCY ACOUSTIC SYSTEM AND METHOD OF USE

CROSS-REFERENCE TO RELATED APPLICATIONS

This application claims benefit to U.S. provisional patent application 63/144,060 filed 2021 Feb. 1 and 63144039 filed 2021 Feb. 1.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

An absorbing system for disrupting short and long sound energy wavelengths. Said absorbing system comprises a two hanging bars, a plurality of hanging straps, a suspended mass assembly. Said suspended mass assembly hangs from said two hanging bars with said plurality of hanging straps. Said suspended mass assembly comprises a suspended absorbing mass. Said suspended absorbing mass comprises a cover and an absorptive portion. Said cover encases and holds said absorptive portion. Said suspended absorbing mass comprises a plurality of depths between a top point and a bottom point. Said plurality of depths comprise a minimum depth and a maximum depth.

BRIEF DESCRIPTION OF THE SEVERAL VIEWS OF THE DRAWING

FIGS. 18A, 18B, and 18C illustrate an elevated side view of a cross-section elevated side view of said absorptive portion 704 and said plurality of panels 200, a wavelength data table 1804, and a wavelength data chart 1806.

FIG. 23 illustrates a suspended mass performance table 2300.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
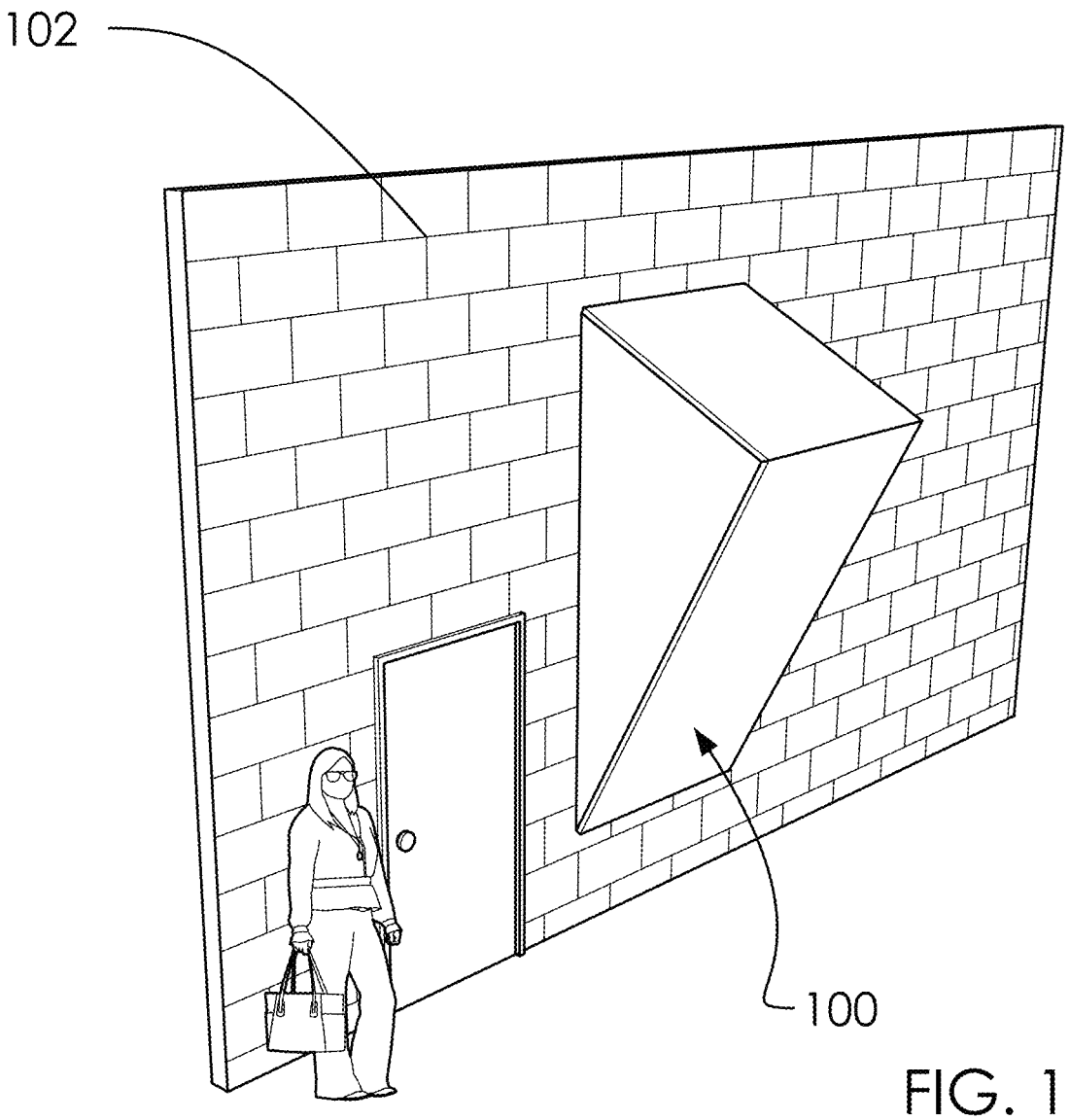
FIGS. 1A, and 1B illustrate a perspective overview of an absorbing system 100 being mounted to a wall 102, and a block diagram 104 of a performance space 106 with a plurality of absorbing systems 108 installed.
Figure 1B:
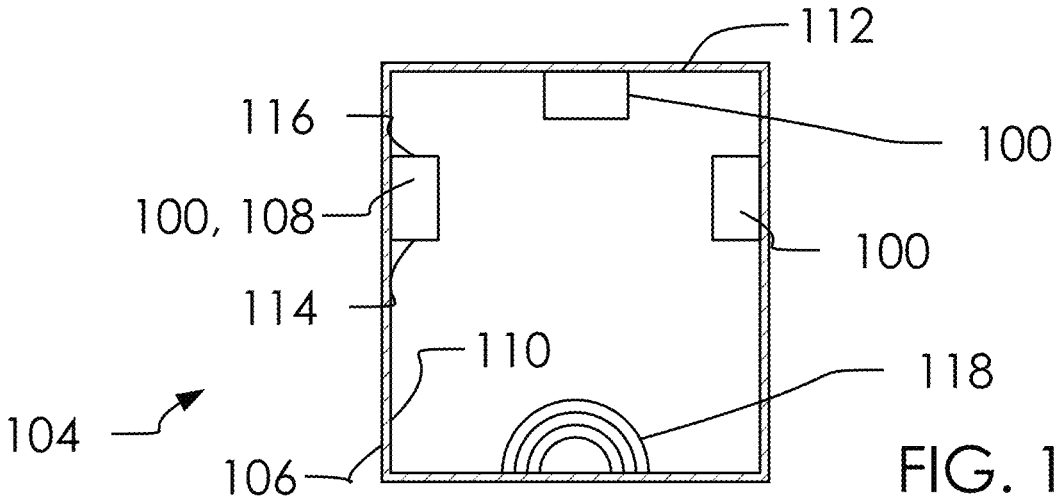

FIGS. 1A, and 1B illustrate a perspective overview of an absorbing system 100 being mounted to a wall 102, and a block diagram 104 of a performance space 106 with a plurality of absorbing systems 108 installed.

In one embodiment, said absorbing system 100 can be mounted on a side wall 110 or a rear wall 112 of a performance space. Wherein, with said absorbing system 100 attached to said side wall 110, said absorbing system 100 can comprise a leading edge 114 and a trailing edge 116 relative to a performance sound source 118.

Figure 2A:
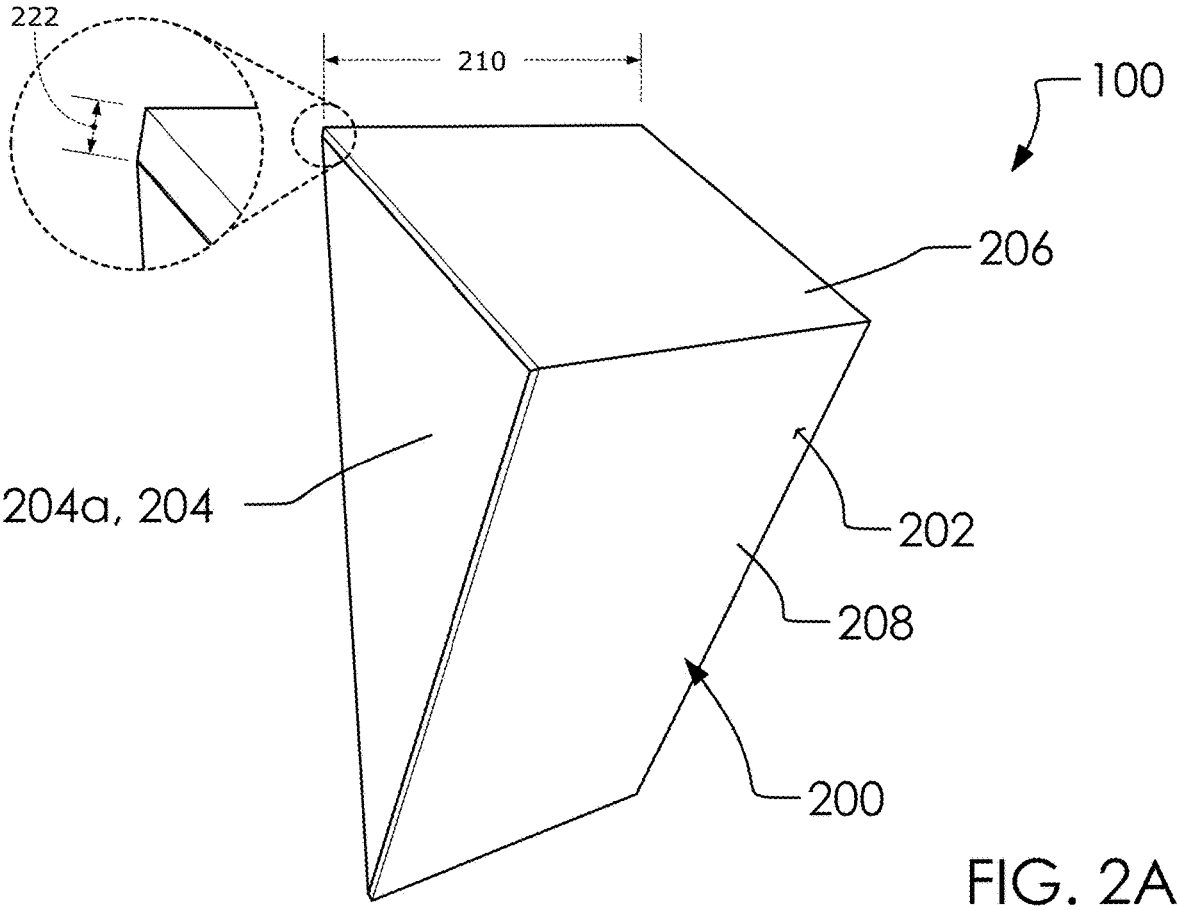
FIGS. 2A, and 2B illustrate a perspective front and rear view of said absorbing system 100.
Figure 2B:
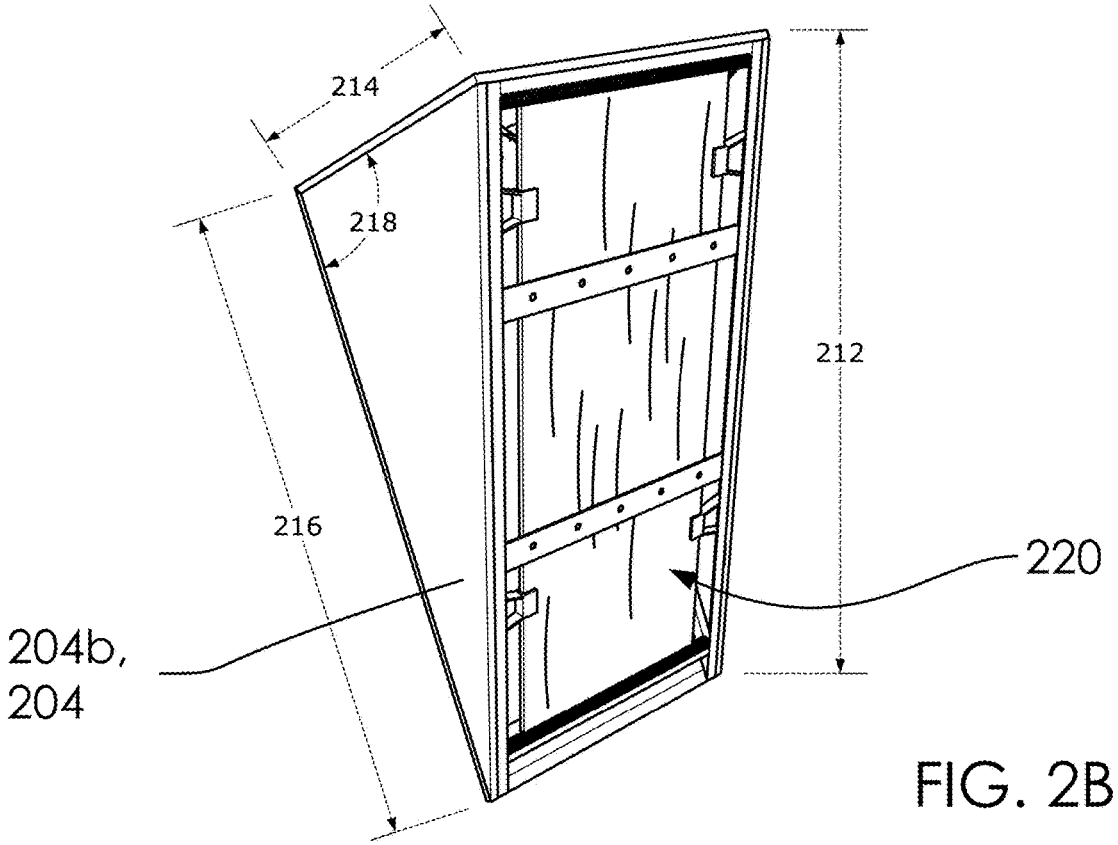

FIGS. 2A, and 2B illustrate a perspective front and rear view of said absorbing system 100.

In one embodiment, said absorbing system 100 can comprise a plurality of panels 200 arranged around an exterior sides 202 of said absorbing system 100.

Said plurality of panels 200 can comprise a two side panels 204 (which can comprise a first side panel 204*a*, and a second side panel 204*b*), an upper front panel 206 and a lower front panel 208.

Said absorbing system 100 can comprise a width 210, a height 212, an upper panel length 214, and a lower panel length 216.

Said two side panels 204 can comprise a triangular shape with a front corner angle 218. In one embodiment, said front corner angle 218 can comprise a right angle; wherein, said upper panel length 214 and said lower panel length 216 can comprise legs and said height 212 can comprise a hypotenuse.

In one embodiment, said height 212 can comprise 9', said lower panel length 216 can comprise 8', said width 210 can comprise 4' and said upper panel length 214 can comprise about 4.1'.

Each of said plurality of panels 200 can comprise a panel thickness 222. In one embodiment, said panel thickness 222 can comprise 1-4 inches with 2 inches being preferred. In one embodiment, said plurality of panels 200 can comprise cloth wrapped being micro perforated.

In one embodiment, said absorbing system 100 can comprise an open back side 220, as illustrated, and as discussed below.

Figure 3:
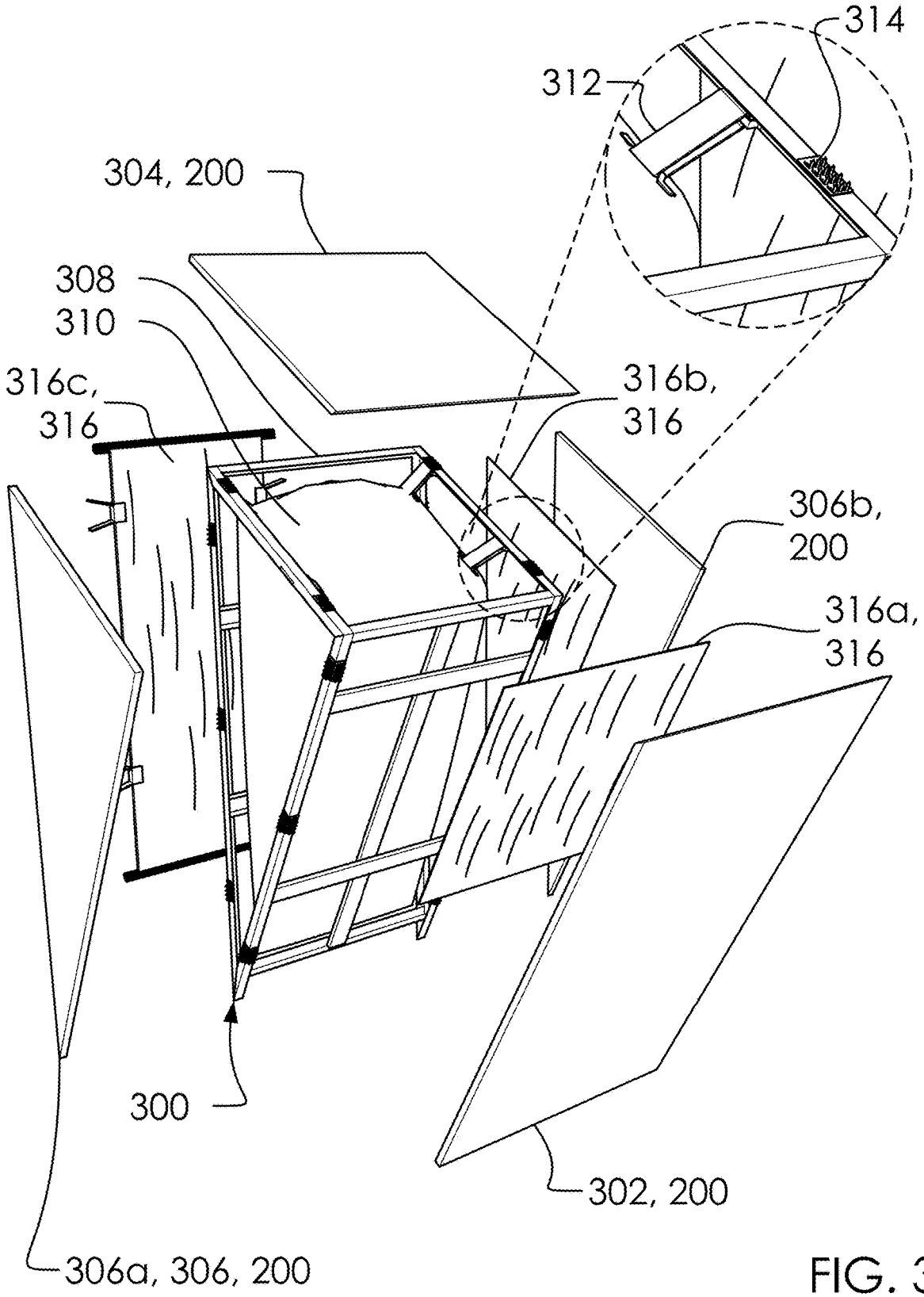
FIG. 3 illustrates an exploded perspective overview of said absorbing system 100 with a plurality of panels 200 being removed from a suspended mass assembly 300.

FIG. 3 illustrates an exploded perspective overview of said absorbing system 100 with said plurality of panels 200 being removed from a suspended mass assembly 300.

Said plurality of panels 200 can comprise a front panel 302, a top panel 304, and a two side panels 306 (comprising a first side panel 306*a*, and a second side panel 306*b*).

Said suspended mass assembly 300 can comprise a frame 308 and a suspended absorbing mass 310. In one embodiment, said suspended absorbing mass 310 can be hung within said frame 308 with a plurality of hanging straps 312. In one embodiment, instead of said plurality of hanging straps 312, z-straps or zip ties can be used.

Said suspended mass assembly 300 can further comprise a plurality of impaling clips 314. In one embodiment, said plurality of panels 200 can selectively attach to said frame 308 with said plurality of impaling clips 314.

Figure 20:
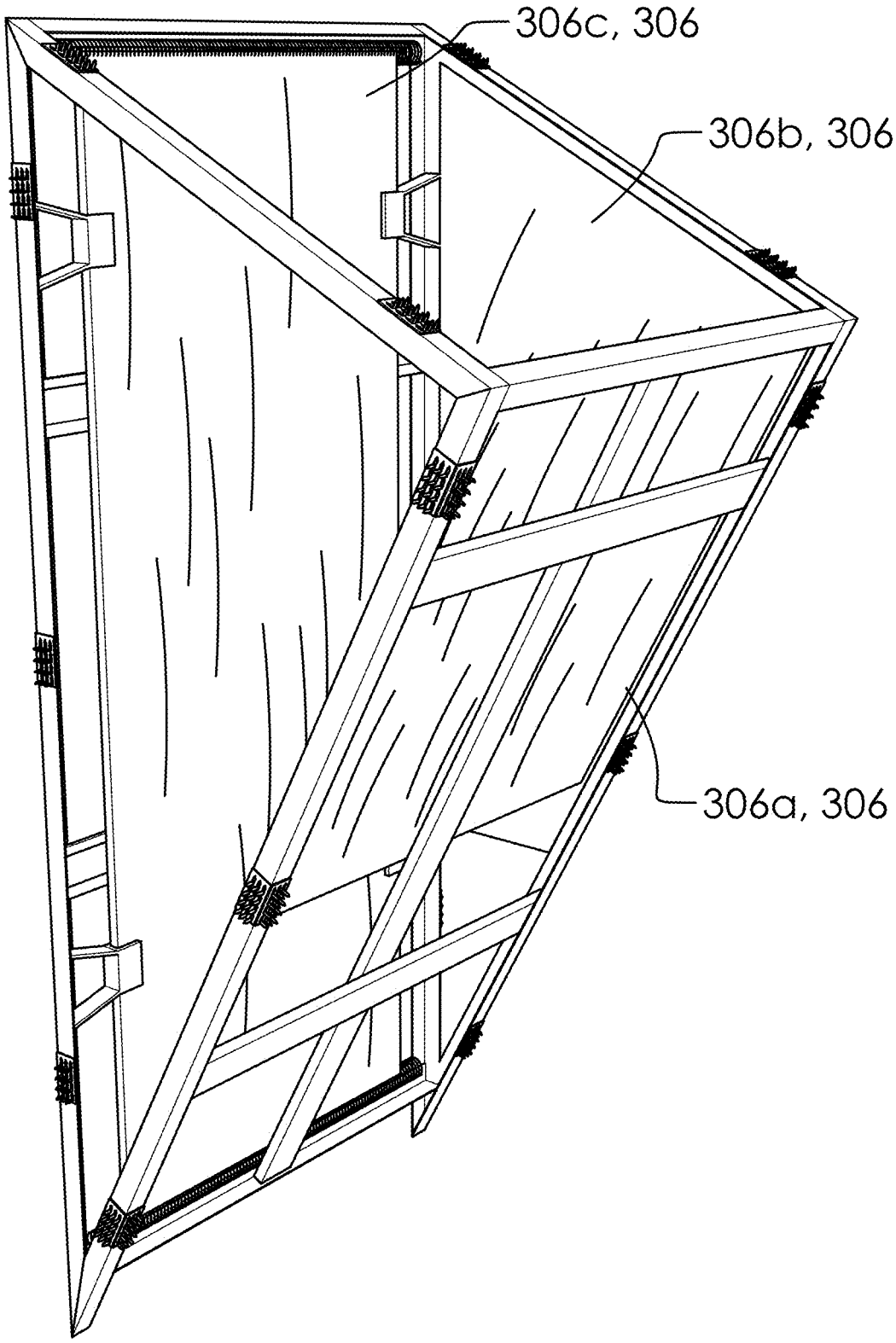
FIG. 20 illustrates a perspective overview of said frame 308 with one or more acoustic plates 316.

Said absorbing system 100 can further comprise one or more acoustic plates 316 (which can comprise a front acoustic plate 316*a*, a first side acoustic plate 316*b*, and a back acoustic plate 316*c*). Each among said one or more acoustic plates 316 can comprise an acoustic membrane positioned between said plurality of panels 200 and said suspended absorbing mass 310. In one embodiment, said one or more acoustic plates 316 can fit within said frame 308, as illustrated in FIGS. 20-21B and to follow. In one embodiment, said one or more acoustic plates 316 can comprise plywood, OSB, or plastic.

Further, said one or more acoustic plates 316 can have a thickness of 1/16th-1/4 inches.

In one embodiment, said front acoustic plate 316*a* and said back acoustic plate 316*c* can create a substantially parallel dual membrane chamber like a dual reed musical instrument. Here, said absorbing system 100 can go about matching frequencies of incoming sound with densities of materials, such as material choices for said one or more acoustic plates 316.

Said two side panels 306 can be installed with said front acoustic plate 316*a* inside of said front panel 302, said back acoustic plate 316*c* at said rear wall 112, and said first side acoustic plate 316*b* at said trailing edge 116 inside of said two side panels 306.

Figure 4A:
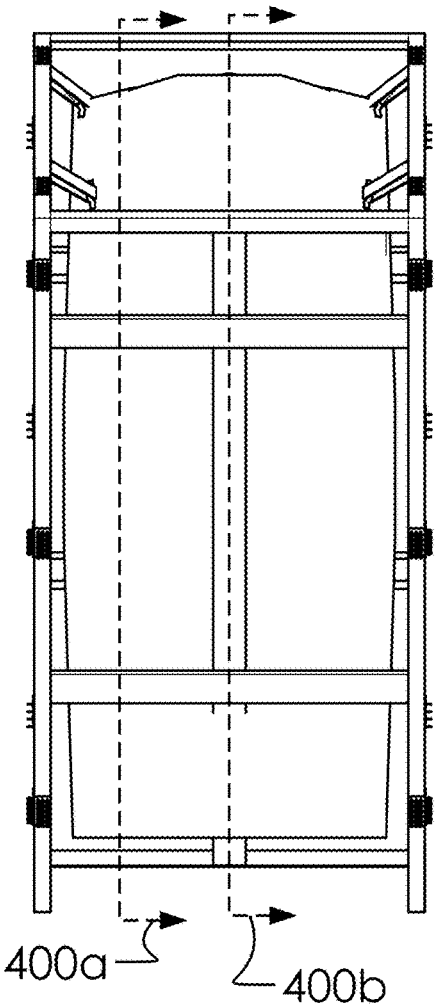
FIGS. 4A, 4B, and 4C illustrate an elevated front view, side view, and top view of said suspended mass assembly 300.
Figure 4B:
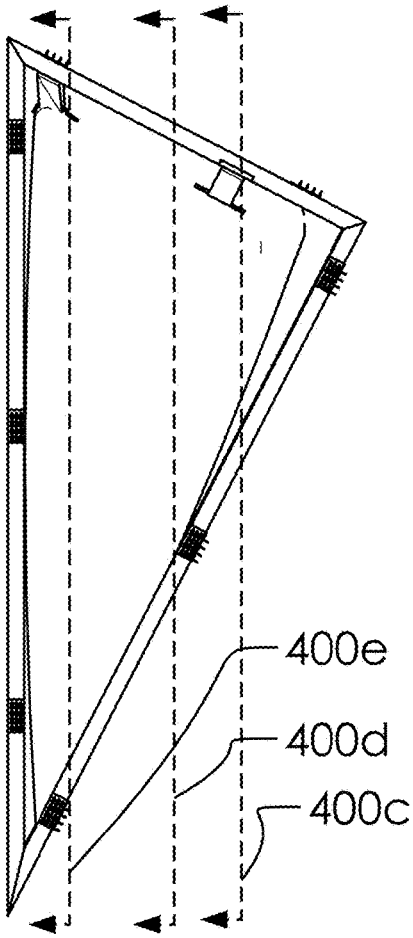
Figure 4C:
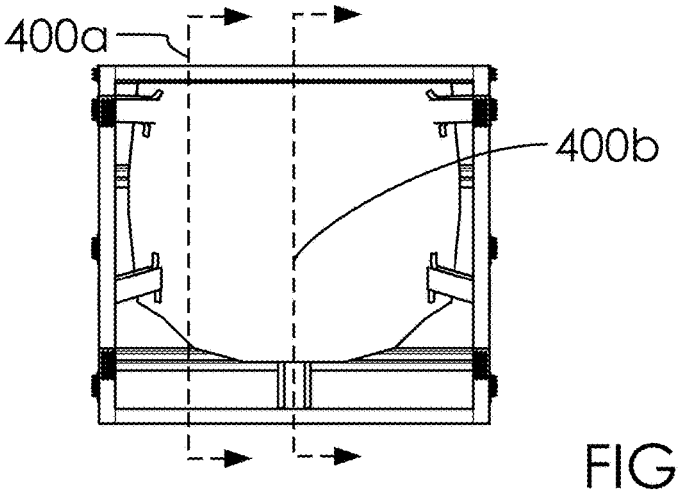

FIGS. 4A, 4B, and 4C illustrate an elevated front view, side view, and top view of said suspended mass assembly 300.

Included in FIGS. 4A-4C are a first cut line 400*a*, a second cut line 400*b*, a third cut line 400*c*, a fourth cut line 400*d*, and a fifth cut line 400*e*, for use in FIGS. 5-10.

Figure 5:
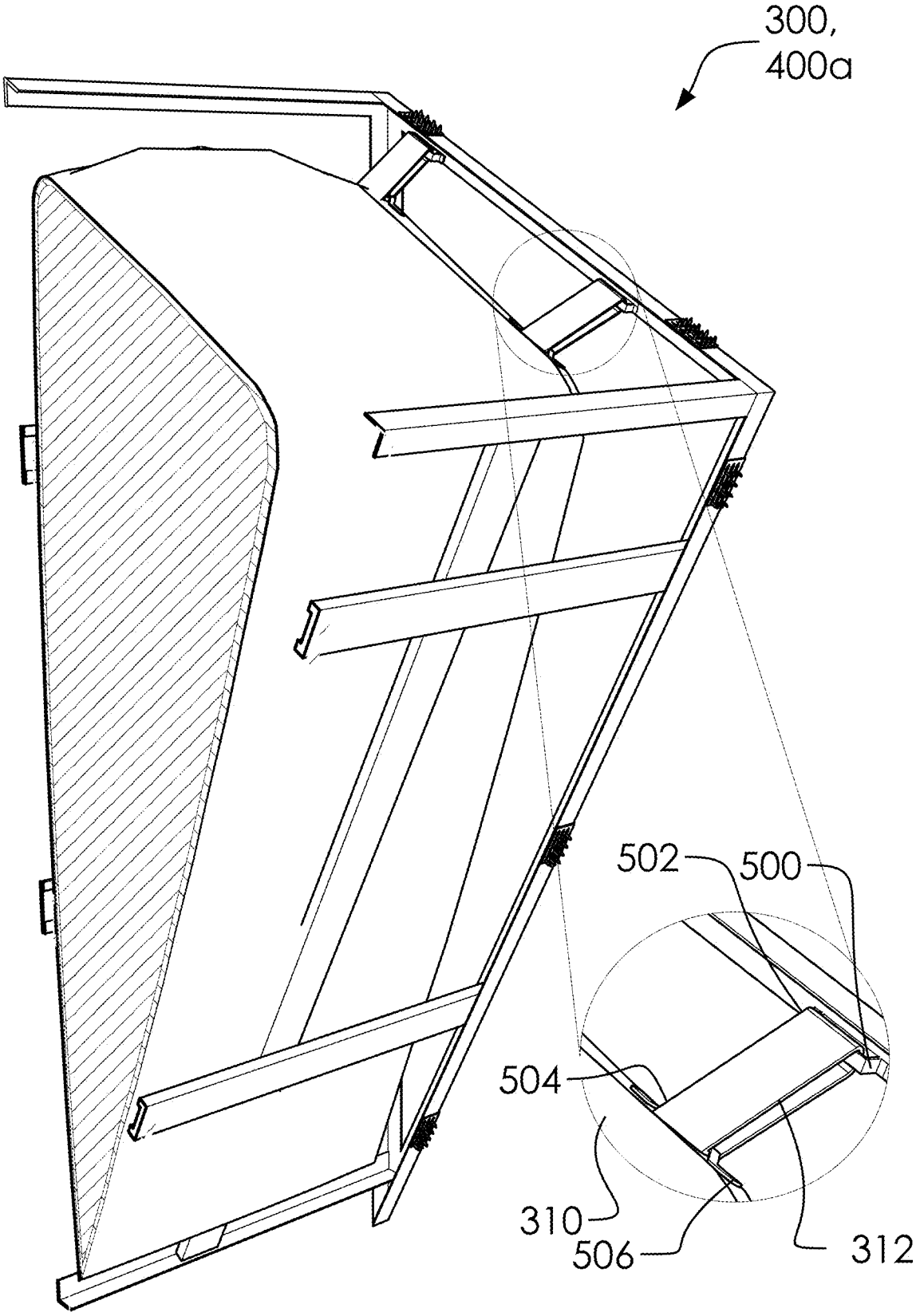
FIG. 5 illustrates a perspective overview of said suspended mass assembly 300 with a cross-section cut at a first cut line 400*a*.

FIG. 5 illustrates a perspective overview of said suspended mass assembly 300 with a cross-section cut at said first cut line 400*a*.

In a detailed view of said plurality of hanging straps 312 it is illustrated that said suspended mass assembly 300 can comprise a plurality of strap hooks 500 configured to receive a first end 502 of a portion of said plurality of hanging straps 312; further, a second end 504 of said plurality of hanging straps 312 can be attached to a top portion of said suspended absorbing mass 310 with a bag strap 506. In one embodiment, said plurality of hanging straps 312 can comprise four straps with two on each side of said suspended mass assembly 300.

Figure 6:
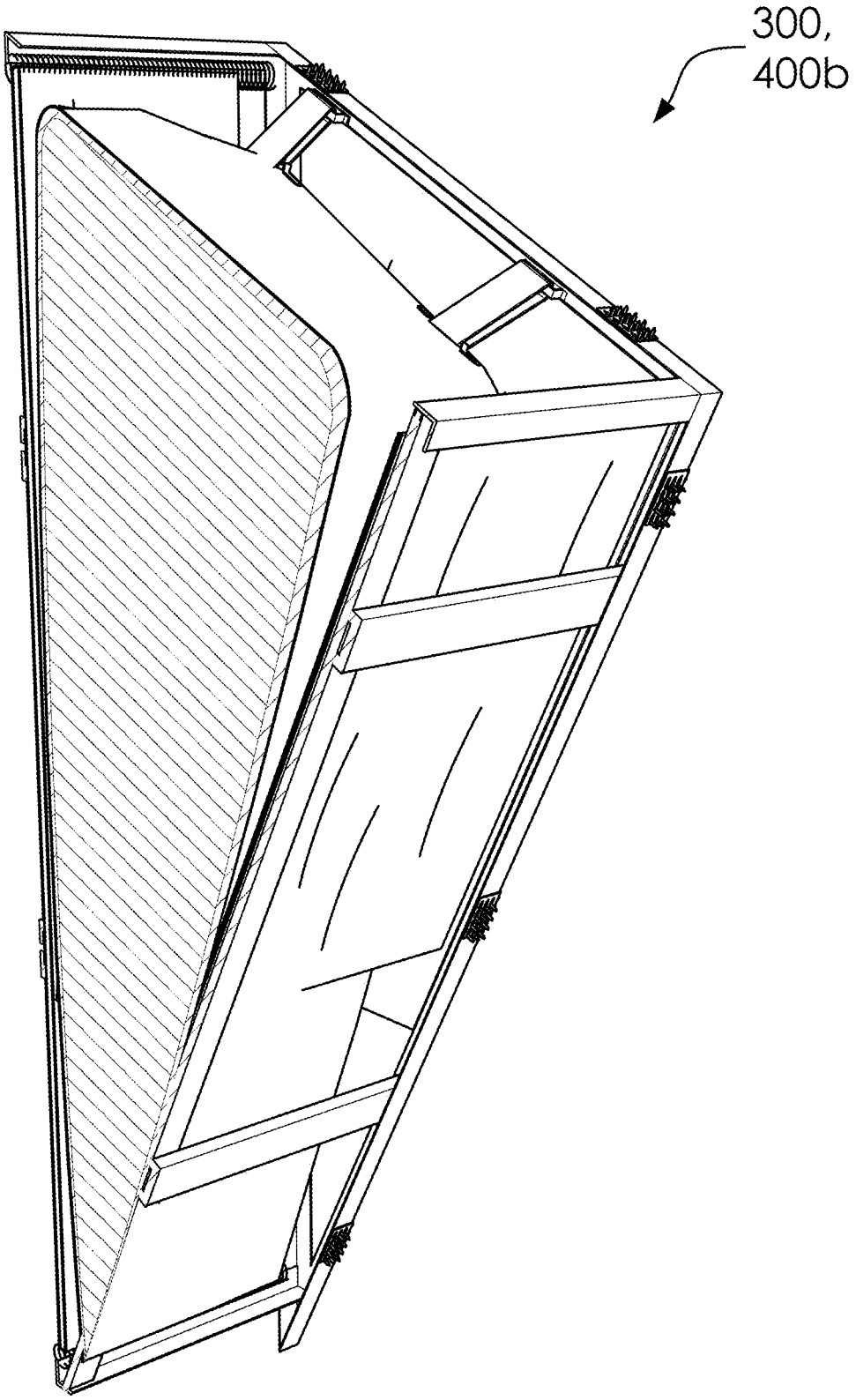
FIG. 6 illustrates a perspective overview of said suspended mass assembly 300 with a cross-section cut at a second cut line 400*b*.

FIG. 6 illustrates a perspective overview of said suspended mass assembly 300 with a cross-section cut at said second cut line 400*b*.

Figure 7:
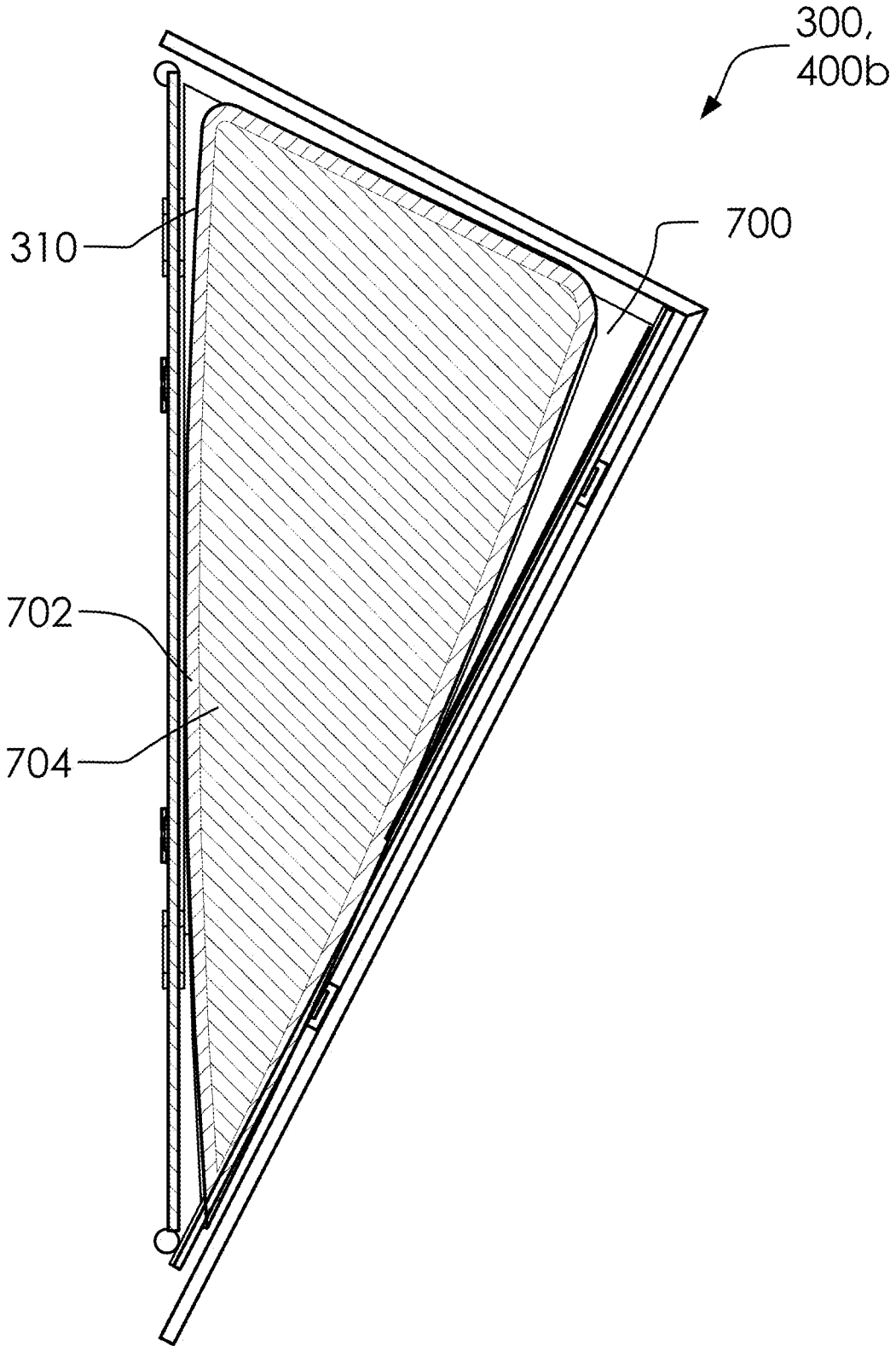
FIG. 7 illustrates an elevated side view of said suspended mass assembly 300 with a cross-section cut at said second cut line 400*b*.

FIG. 7 illustrates an elevated side view of said suspended mass assembly 300 with a cross-section cut at said second cut line 400*b*.

In one embodiment, an air gap 700 can surround above and in front of said suspended absorbing mass 310. The position of said air gap 700 can ensure that said suspended absorbing mass 310 does not touch portions of said suspended mass assembly 300 or said plurality of panels 200.

In one embodiment, said suspended absorbing mass 310 can comprise a cover 702 and an absorptive portion 704. Said cover 702 can comprise a septum, a bag, or an encasement. In one embodiment, said cover 702 can comprise a cloth and plastic combination.

Figure 8:
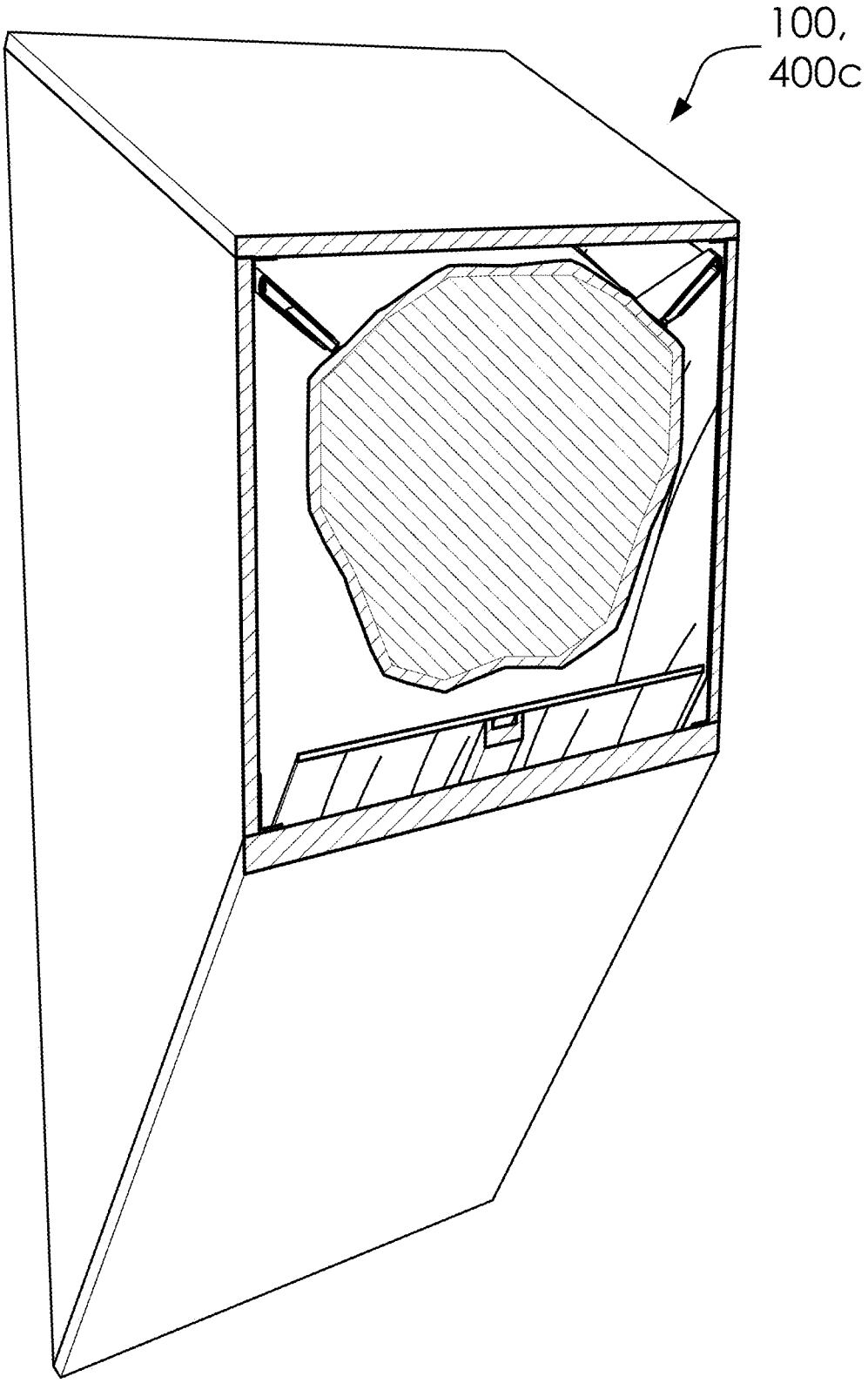
FIG. 8 illustrates a perspective overview of said suspended mass assembly 300 with a cross-section cut at a third cut line 400*c*.

FIG. 8 illustrates a perspective overview of said suspended mass assembly 300 with a cross-section cut at said third cut line 400*c*.

Figure 9:
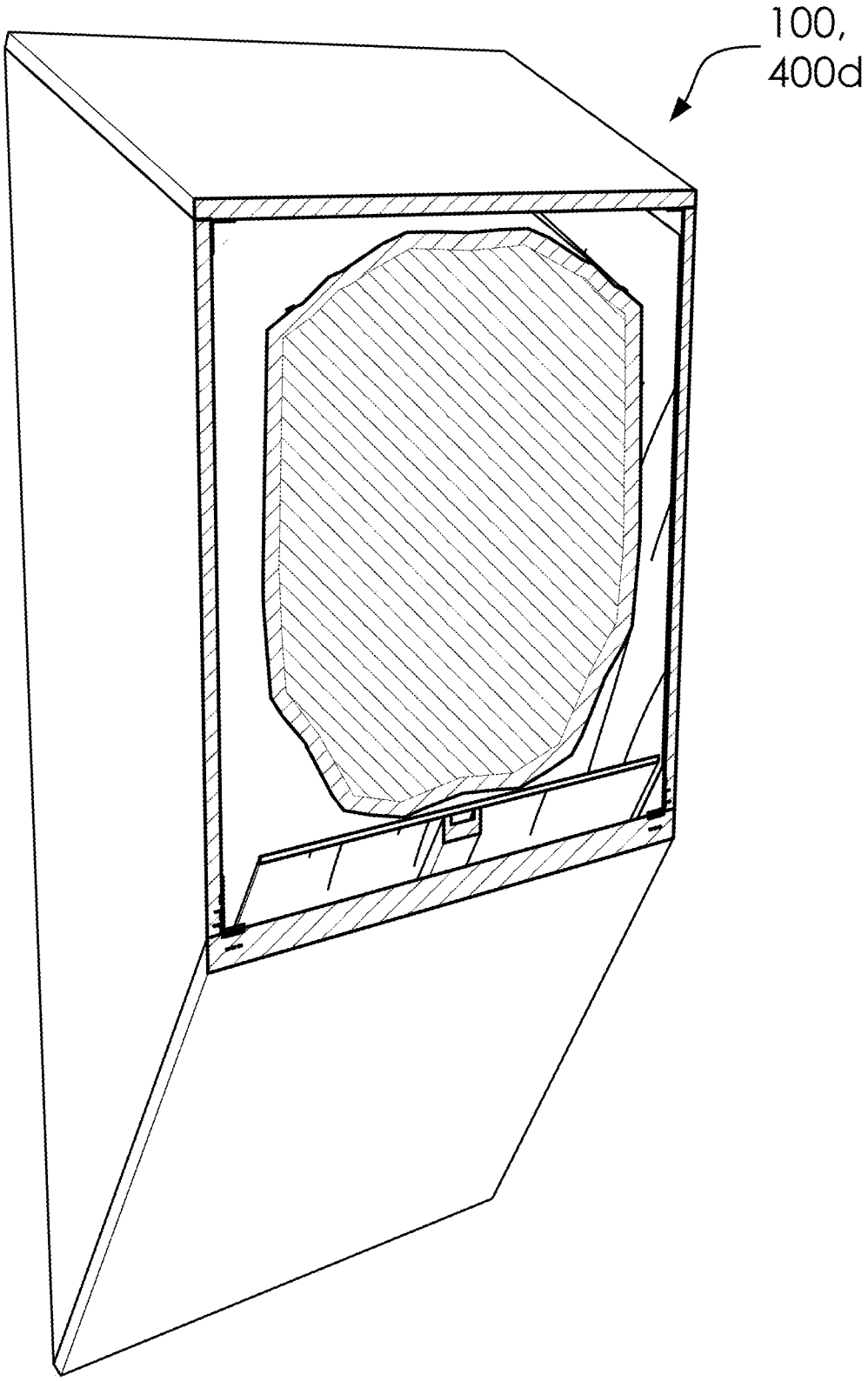
FIG. 9 illustrates a perspective overview said suspended mass assembly 300 with a cross-section cut at a fourth cut line 400*d*.

FIG. 9 illustrates a perspective overview said suspended mass assembly 300 with a cross-section cut at said fourth cut line 400*d*.

Figure 10:
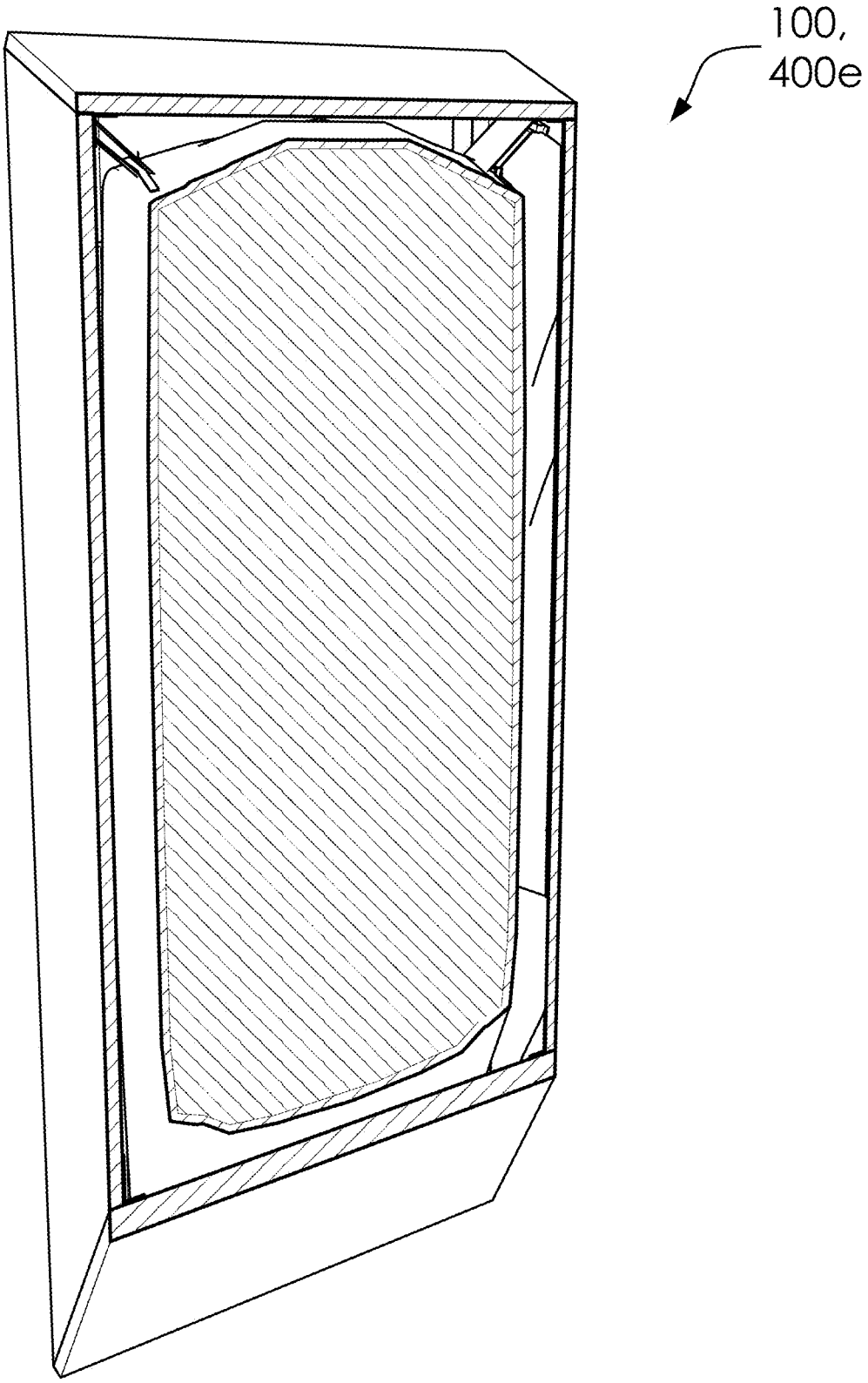
FIG. 10 illustrates a perspective overview said suspended mass assembly 300 with a cross-section cut at a fifth cut line 400*e*.

FIG. 10 illustrates a perspective overview said suspended mass assembly 300 with a cross-section cut at said fifth cut line 400*e*.

Figure 11:
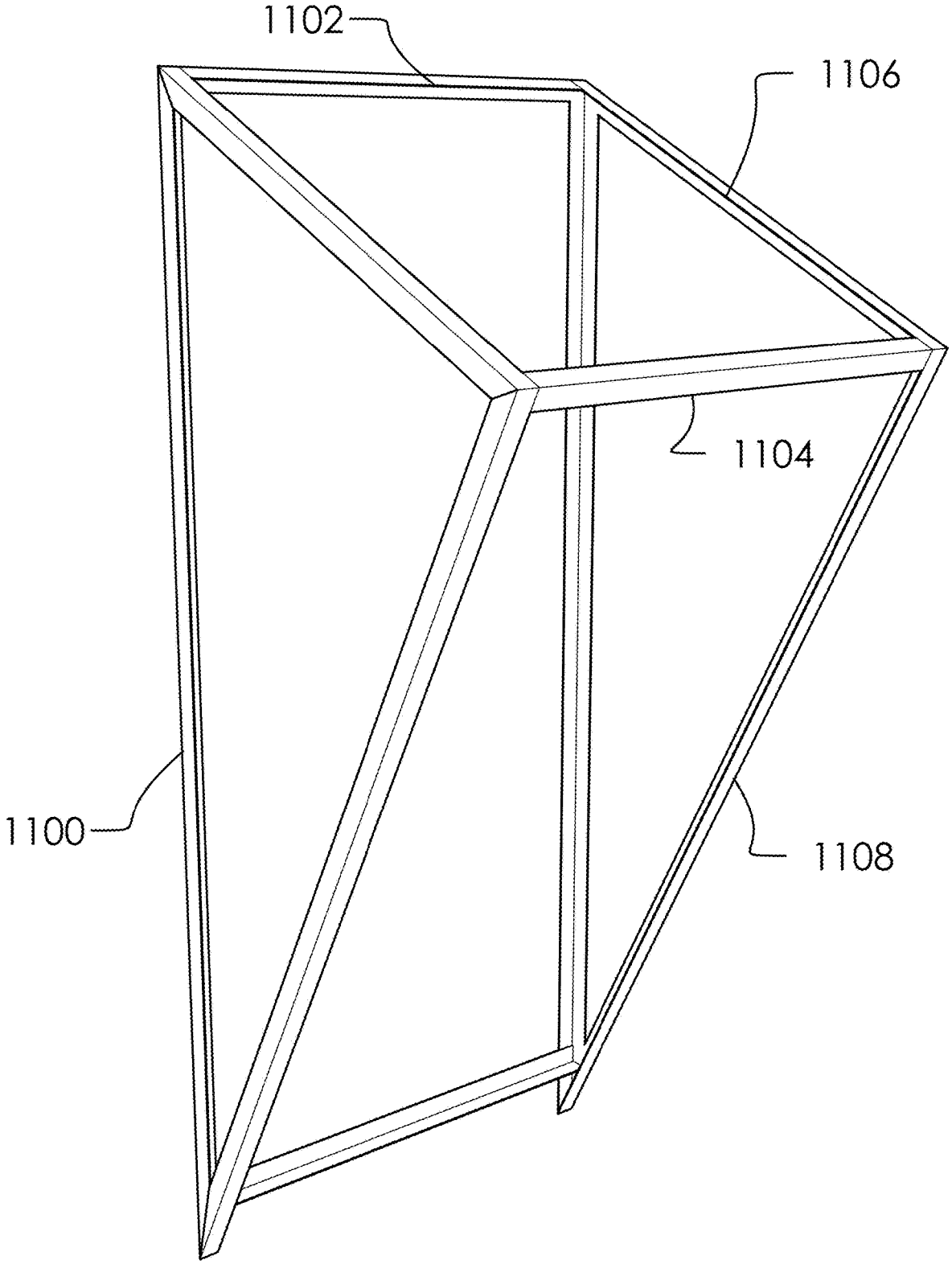
FIG. 11 illustrates a perspective overview of a frame 308.

FIG. 11 illustrates a perspective overview of said frame 308.

Said frame 308 can comprise a two vertical bars 1100, a two rear horizontal bars 1102, a front horizontal bar 1104, a two hanging bars 1106, and a two lower side bars 1108. Each of said bars can comprise an L-shaped cross-section.

Figure 12:
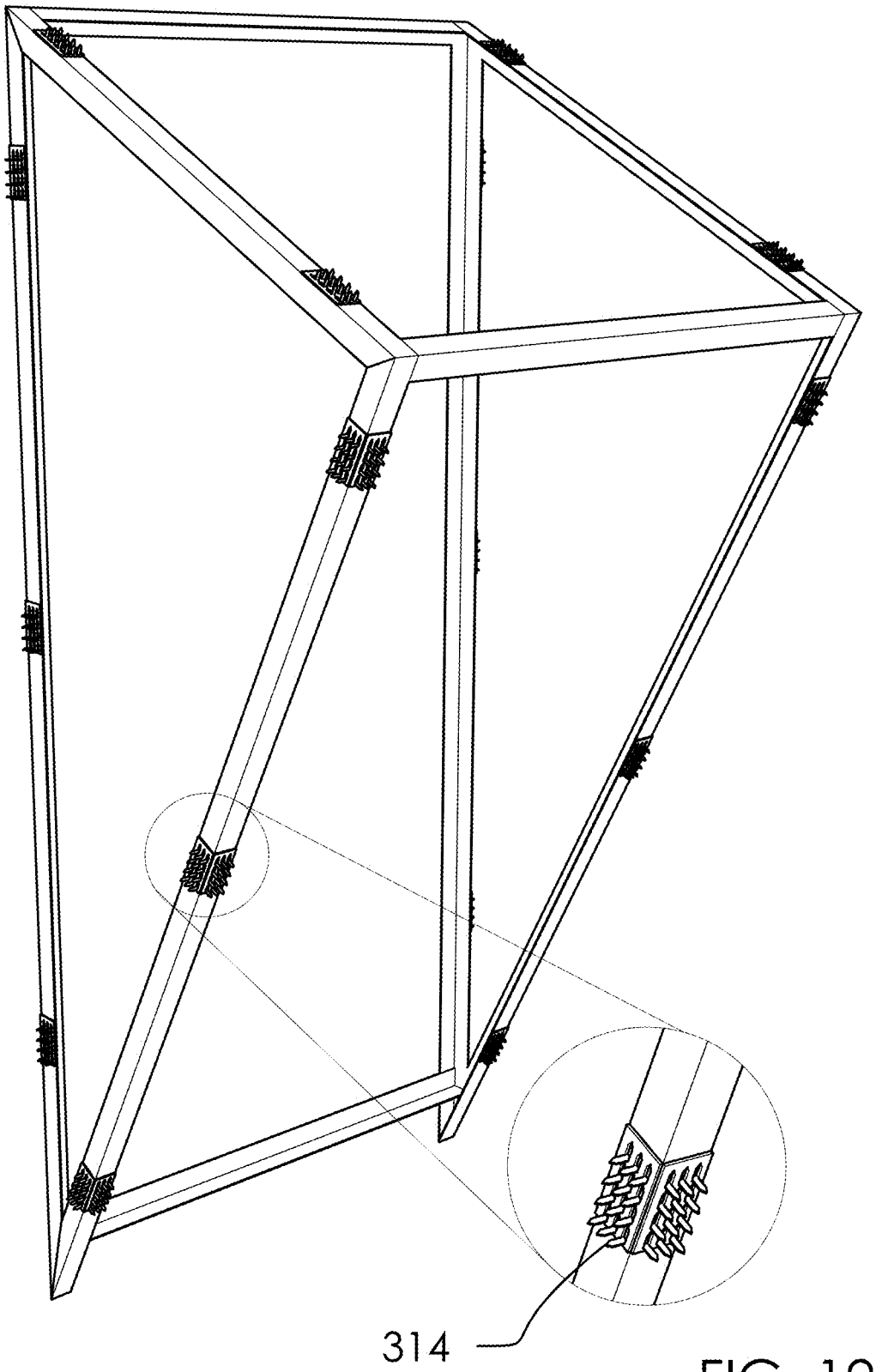
FIG. 12 illustrates a perspective overview of said frame 308 with a plurality of impaling clips 314.

FIG. 12 illustrates a perspective overview of said frame 308 with said plurality of impaling clips 314.

Figure 13:
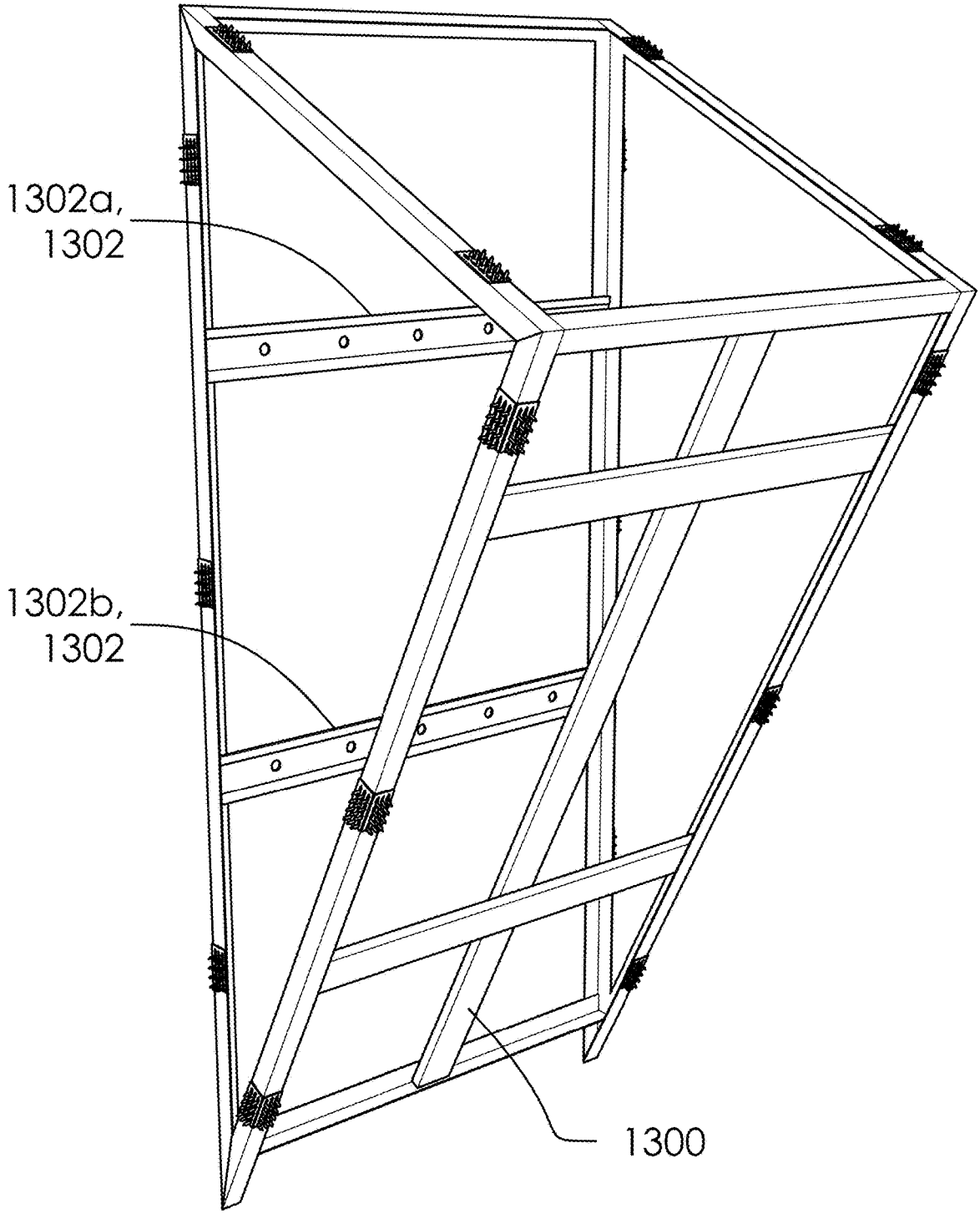
FIG. 13 illustrates a perspective overview of said frame 308 with a lower front frame 1300, and one or more rear crossbars 1302.

FIG. 13 illustrates a perspective overview of said frame 308 with a lower front frame 1300, and one or more rear crossbars 1302.

Said one or more rear crossbars 1302 can comprise a first rear crossbar 1302*a*, and a second rear crossbar 1302*b*.

In one embodiment, said lower front frame 1300 can provide structure and support to said lower front panel 208. Said one or more rear crossbars 1302 can cross between said two vertical bars 1100 and be selectively attached to said wall 102 to mount said absorbing system 100.

Figure 14A:
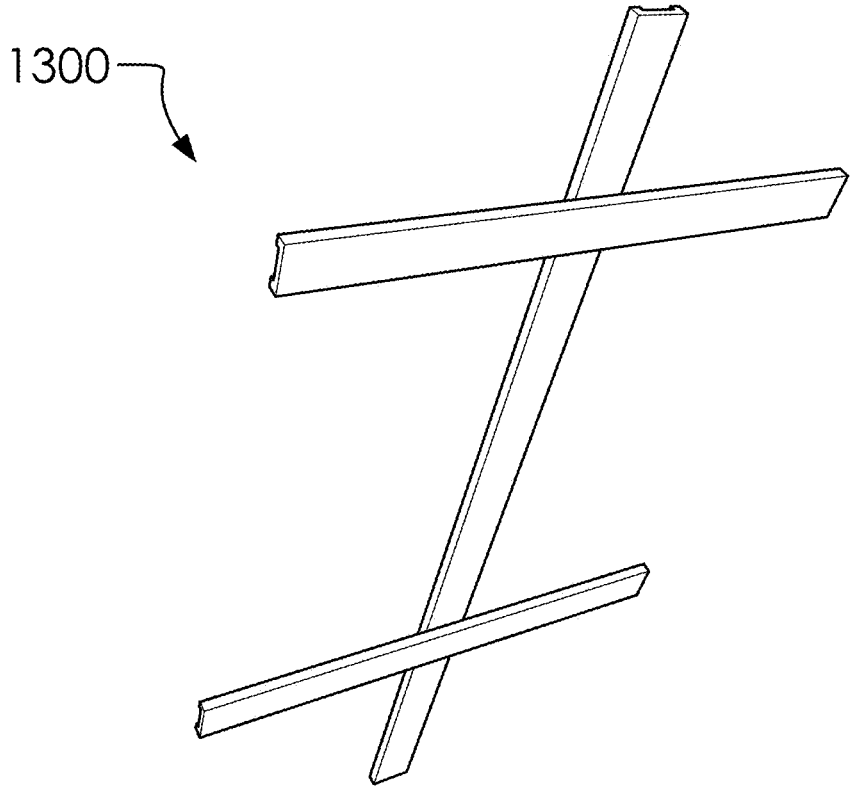
FIGS. 14A, and 14B illustrate a perspective overview and rear view of said lower front frame 1300.
Figure 14B:
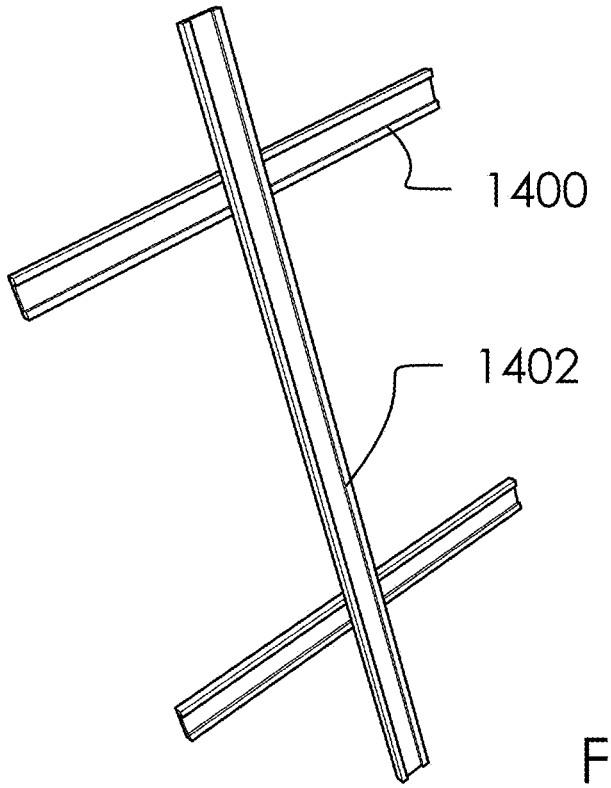

FIGS. 14A, and 14B illustrate a perspective overview and rear view of said lower front frame 1300.

Said lower front frame 1300 can comprise a two horizontal bars 1400 and a vertical bar 1402, being arranged, as illustrated, to fill a space between a lower of said two rear horizontal bars 1102, said front horizontal bar 1104 and said two lower side bars 1108.

Figure 15A:
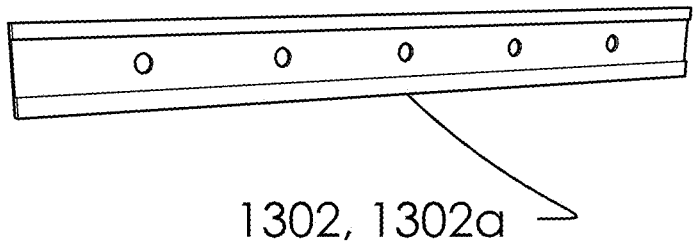
FIGS. 15A, and 15B illustrate a perspective overview and rear view of a first rear crossbar 1302*a* and a second rear crossbar 1302*b*.
Figure 15A:
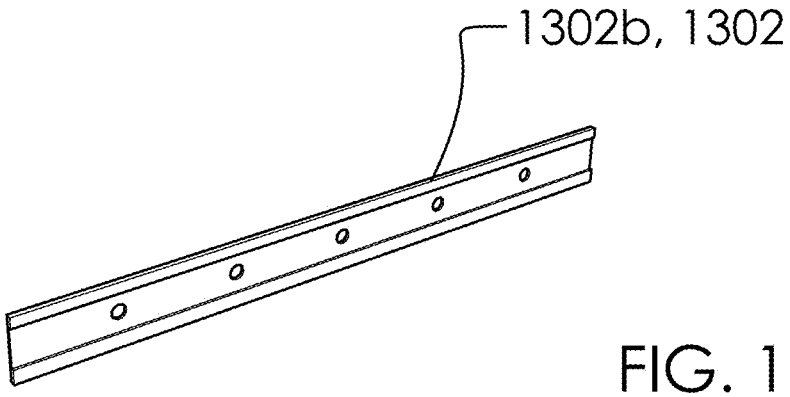
Figure 15B:
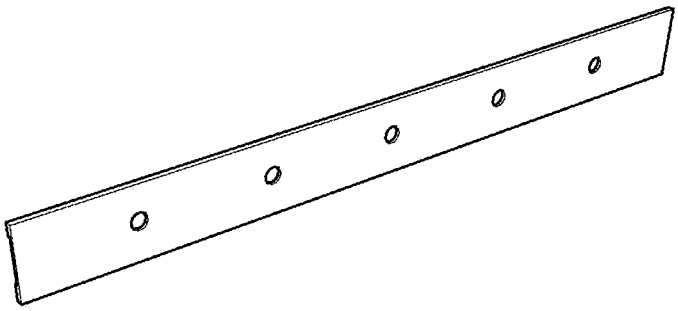
Figure 15B:
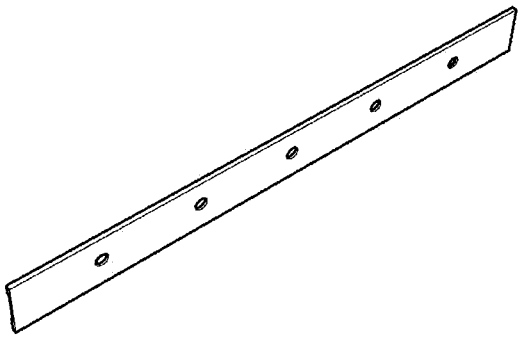

FIGS. 15A, and 15B illustrate a perspective overview and rear view of said first rear crossbar 1302*a* and said second rear crossbar 1302*b*.

Figure 16:
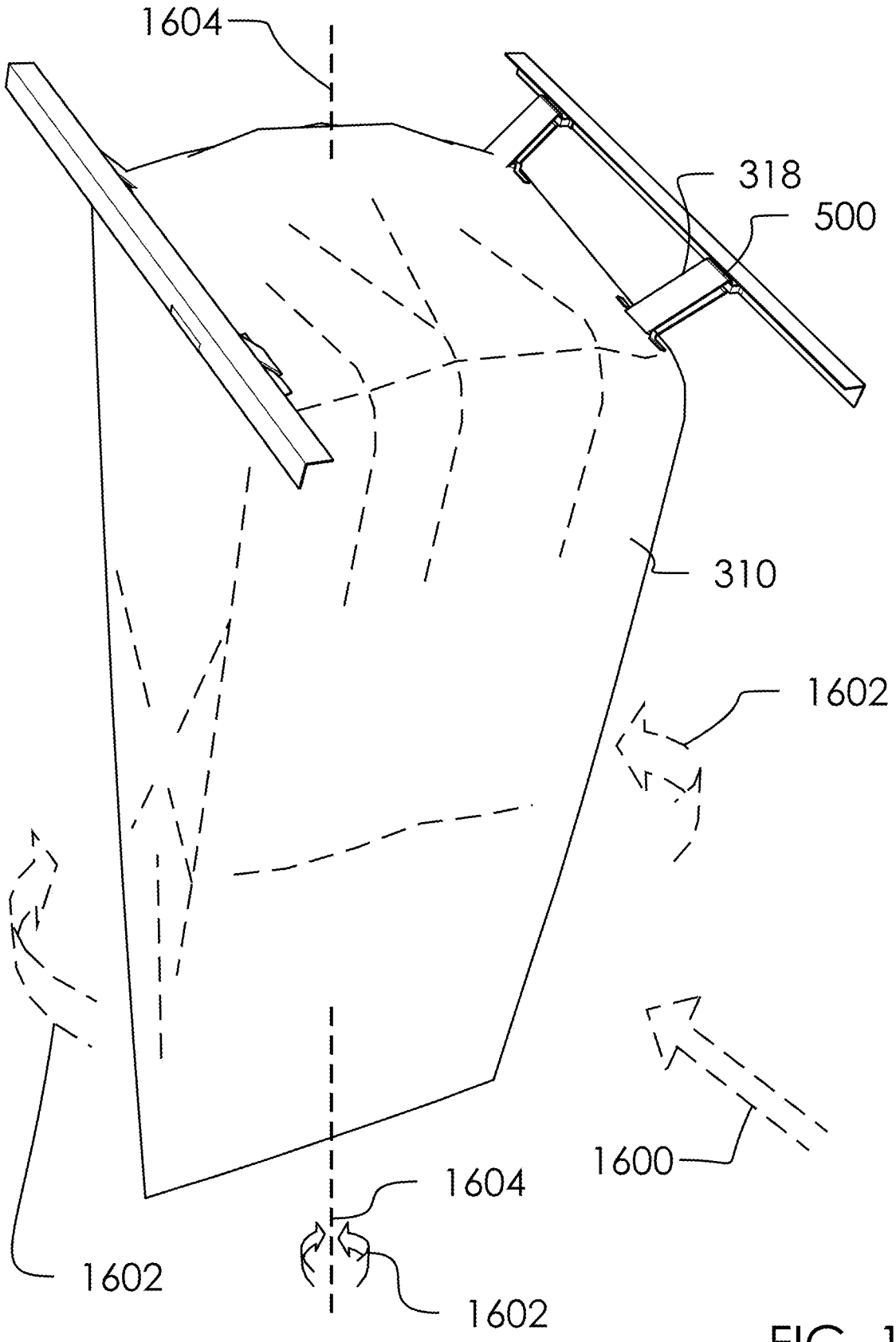
FIG. 16 illustrates a perspective overview of a suspended absorbing mass 310 hanging from a plurality of strap hooks 500 with a plurality of hanging straps 312 from a top portion of said frame 308.

FIG. 16 illustrates a perspective overview of said suspended absorbing mass 310 hanging from said plurality of strap hooks 500 with said plurality of hanging straps 312 from a top portion of said frame 308.

In one embodiment, a sound energy 1600 can be directed at said absorbing system 100; wherein, since said suspended absorbing mass 310 is suspended from above with said plurality of hanging straps 312, it is free to absorb said sound energy 1600 and move in a twisting motion 1602 about a vertical axis 1604. Accordingly, vibrations can be absorbed more freely due to said twisting motion 1602.

Figure 17:
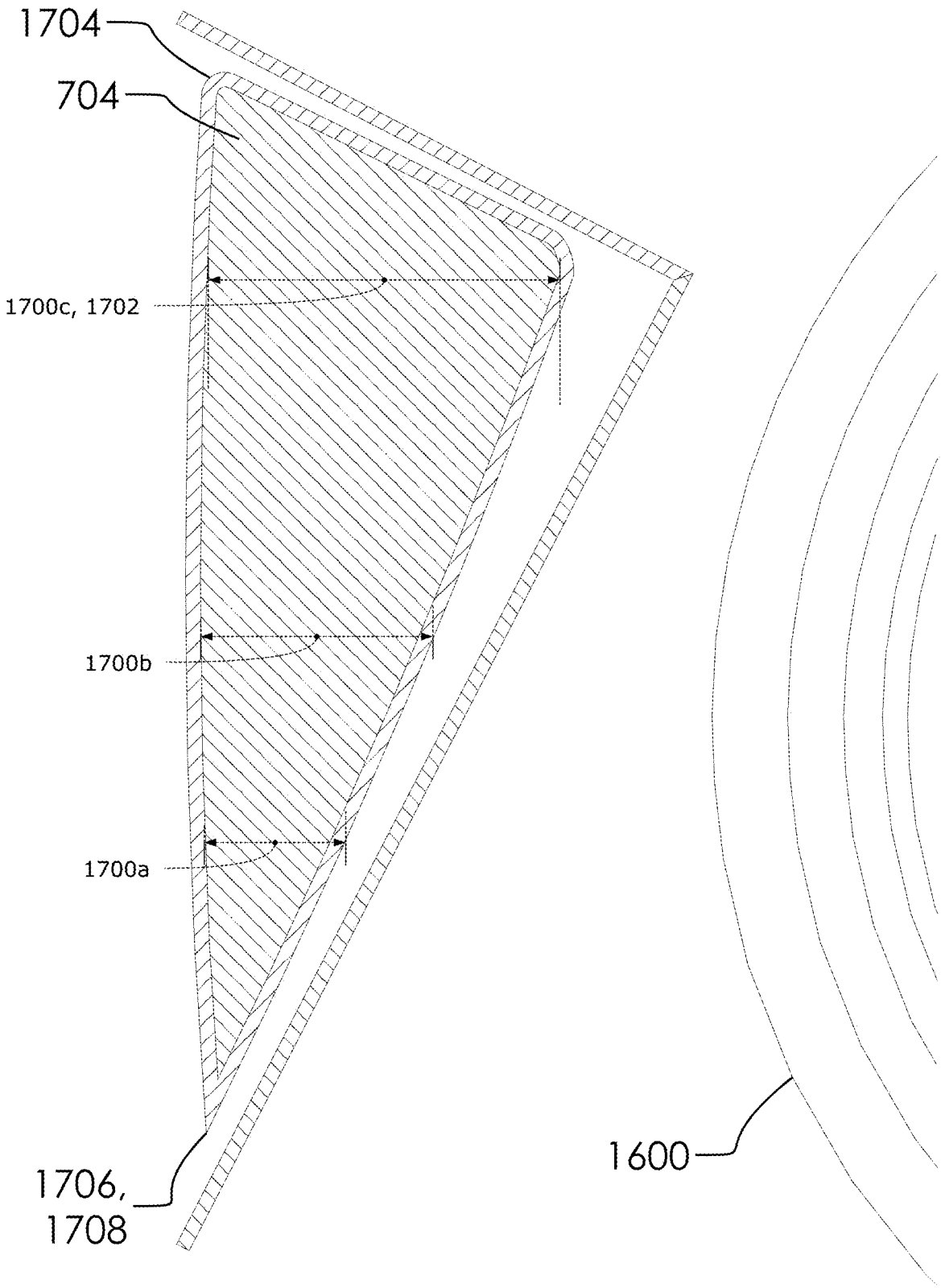
FIG. 17 illustrates a cross-section elevated side view of an absorptive portion 704 and said plurality of panels 200.

FIG. 17 illustrates a cross-section elevated side view of said absorptive portion 704 and said plurality of panels 200.

In one embodiment, said absorptive portion 704 can comprise a plurality of depths 1700 (which can comprise a first depth 1700*a*, a second depth 1700*b*, a third depth 1700*c* and a maximum depth 1702) between a top point 1704 and a bottom point 1706.

Since said absorptive portion 704 comprises a substantially triangular cross section relative to said sound energy 1600, a full range of depths are incrementally represented within said plurality of depths 1700 as between a minimum depth 1708 (here being zero) and said maximum depth 1702.

FIGS. 18A, 18B, and 18C illustrate an elevated side view of a cross-section elevated side view of said absorptive portion 704 and said plurality of panels 200, a wavelength data table 1804, and a wavelength data chart 1806.

As is known, said sound energy 1600 can comprise sound energy comprising various frequencies at a plurality of wavelengths 1800. As illustrated, said plurality of wavelengths 1800 can comprise a first wavelength 1802*a*, and a second wavelength 1802*b*. As illustrated, an anticipated travel direction 1808 of said sound energy 1600 in said performance space 106 is contemplated.

Although it more ideal to absorb said sound energy 1600 with said absorptive portion 704 being equally as thick as the soundwave to be absorbed, this is impractical. Namely, because many common base wavelengths can be relatively large in a listening space. For example, a subwoofer may commonly create wavelengths of 10 to 30 feet in length. There are not many rooms in which a 30-foot absorber can be easily placed.

However, a lesser-known property is being employed by said absorbing system 100; namely, a soundwave can be substantially broken up with an absorber being approximately one tenth (1/10th) as thick as the wavelength is long. This one tenth ratio represents an inverse relationship to wavelength. For example, a 63 Hz wavelength is 17.24 feet long, thus 1.72 feet—or 20.69 inches—of absorber can substantially disrupt a 63 Hz wavelength. Given that it is generally accepted standard hearing range for humans is 20 to 20,000 Hz. In air at atmospheric pressure, these represent sound waves with wavelengths of 17 meters (56 ft) to 1.7 centimeters (0.67 in). Thus, where said maximum depth 1702 of said absorptive portion 704 is about 30 inches, substantially all soundwaves can be disrupted.

Since said plurality of depths 1700 are linearly presented from said bottom point 1706 to said maximum depth 1702, a smooth cancellation and disruption will occur across the spectrum.

Figures 19A, 19B:
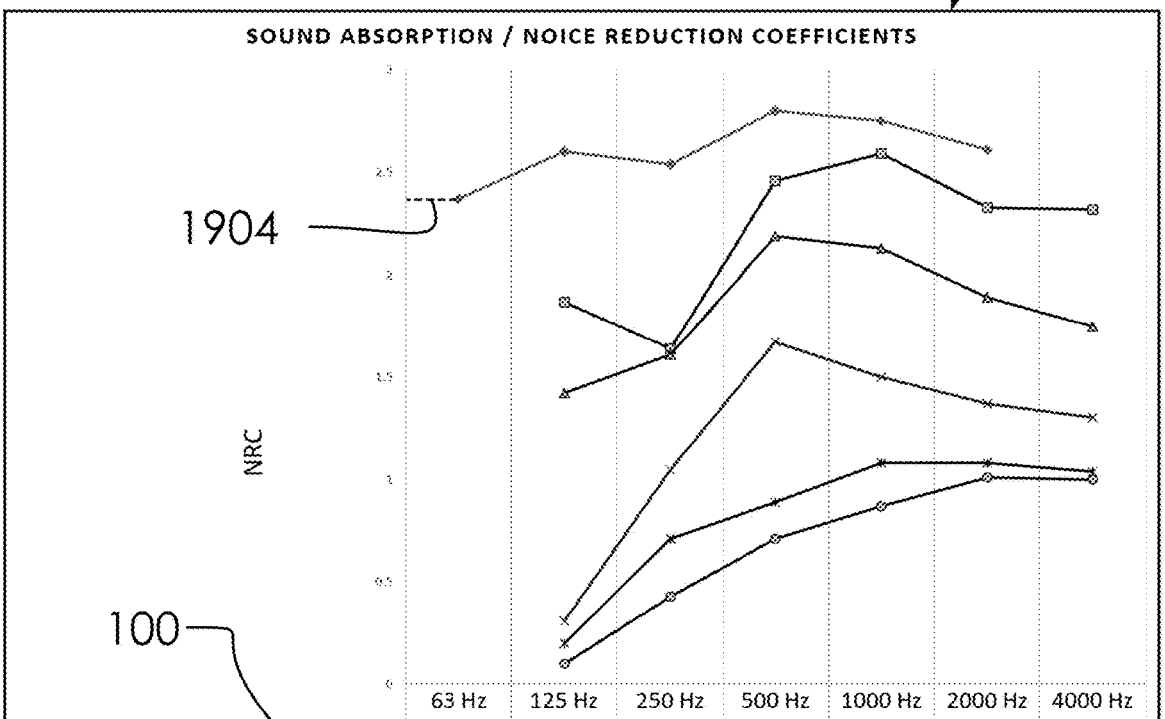
FIGS. 19A, and 19B illustrate a testing results chart and data table 1900 and an NRC results data table 1902.

FIGS. 19A, and 19B illustrate a testing results chart and data table 1900 and an NRC results data table 1902.

As shown, said absorbing system 100 is labeled as "Internal Limp Mass". The underlying tests were conducted in a controlled environment and demonstrate the unexpected results of the current system compared with prior art absorbers.

In one embodiment, said absorbing system 100 can comprise a projected low frequency NRC 1904, as illustrated.

FIG. 20 illustrates a perspective overview of said frame 308 with said one or more acoustic plates 316.

In one embodiment, by placing said first side acoustic plate 316*b* at said trailing edge 116 relative to said performance sound source 118 a first reflection of said sound energy 1600 will enter said absorbing system 100 at a side without said one or more acoustic plates 316 then need to penetrate all said suspended absorbing mass 310 and said first side acoustic plate 316*b* before exiting said absorbing system 100. Likewise, when an initial reflection of said sound energy 1600 becomes a residual reflection and is bouncing around said performance space 106, it will enter said absorbing system 100 from all sides, as previously discussed.

Figure 21A:
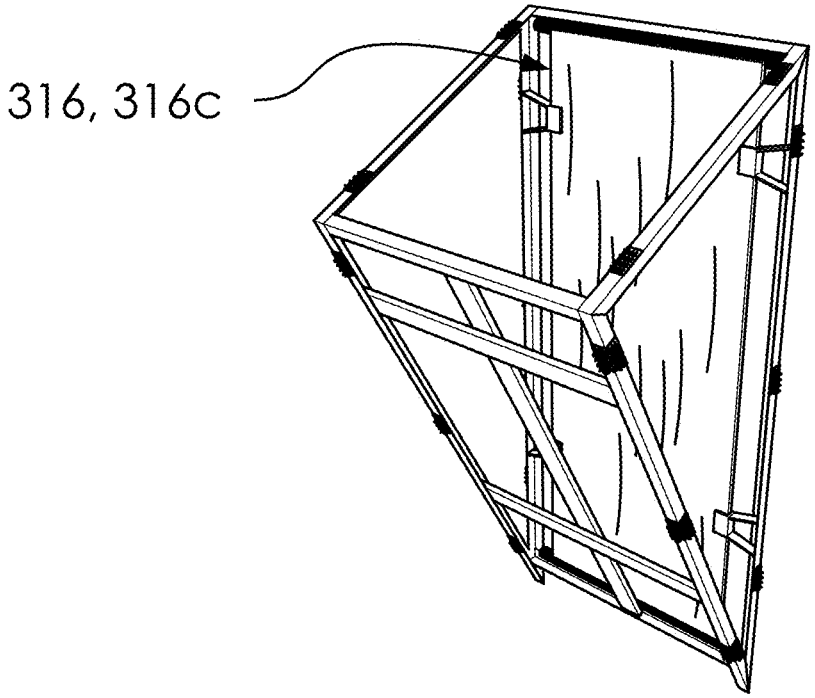
FIGS. 21A, and 21B illustrate a perspective overview and rear view of said frame 308 with said one or more acoustic plates 316 without said one or more rear crossbars 1302.
Figure 21B:
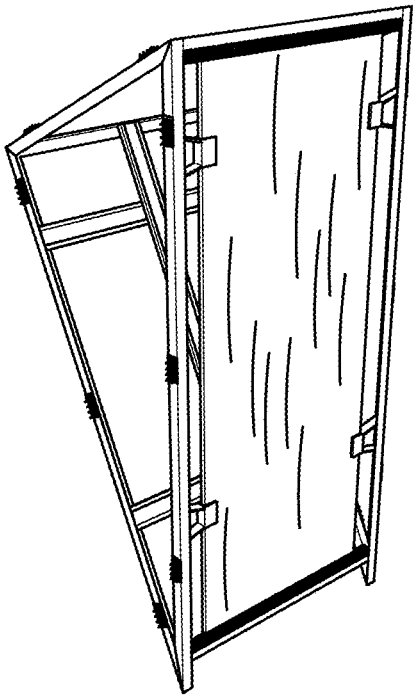

FIGS. 21A, and 21B illustrate a perspective overview and rear view of said frame 308 with said one or more acoustic plates 316 without said one or more rear crossbars 1302.

In one embodiment, said back acoustic plate 316*c* can be suspended without said one or more rear crossbars 1302 to allow said back acoustic plate 316*c* to move without contacting a portion of said frame 308 or said one or more rear crossbars 1302. Wherein, said back acoustic plate 316*c* can provide structural support to said frame 308 instead of said one or more rear crossbars 1302.

Figure 22A:
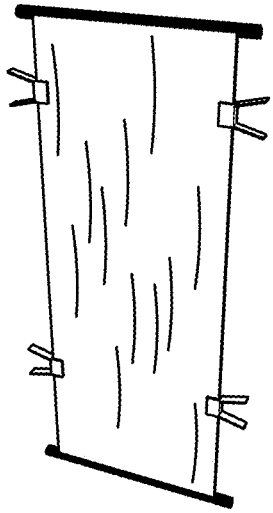
FIGS. 22A, and 22B illustrate a perspective overview and an elevated front view of a back acoustic plate 316*c*.
Figure 22B:
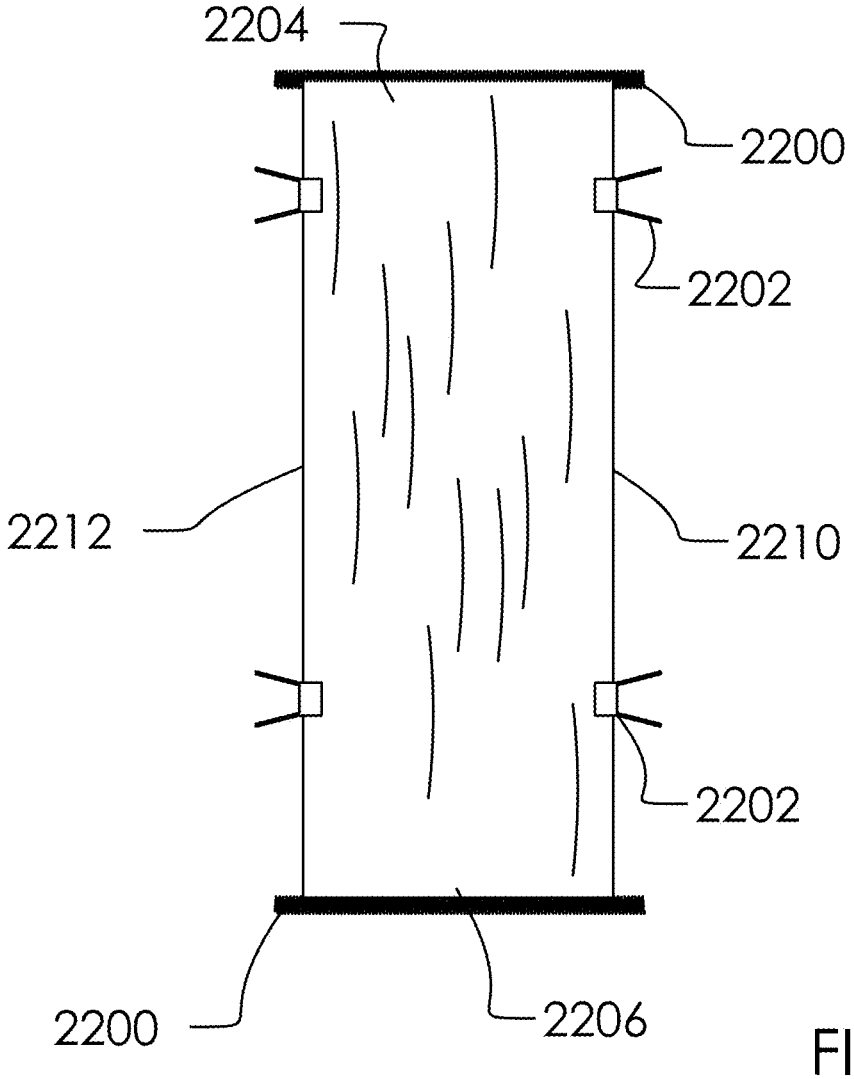

FIGS. 22A, and 22B illustrate a perspective overview and an elevated front view of said back acoustic plate 316*c*.

In one embodiment, said one or more acoustic plates 316 can be suspended within said absorbing system 100 to absorb said sound energy 1600. One method of suspending said one or more acoustic plates 316 can comprise attaching an elastic assembly at one or more edges of said one or more acoustic plates 316. In one embodiment, said elastic assembly can comprise one or more springs 2200 or one or more side supports 2202.

In one embodiment, said one or more springs 2200 can attach to a top end 2204 and a bottom end 2206 of said back acoustic plate 316*c*, as illustrated.

Said one or more side supports 2202 can comprise four side supports being attached to a first side 2208 and a second side 2210 of said back acoustic plate 316*c*.

In one embodiment, said one or more acoustic plates 316 can comprise plastic, rubber, or plywood.

In one embodiment, said one or more springs 2200 and said one or more side supports 2202 can interact with one another just as shocks and struts do in vehicles, that is one being mechanical and the other elastic, they can help to cancel one another out.

Whereby, said one or more acoustic plates 316 can be suspended to allow movement which is actively dampened. Unlike anything in the prior art, said one or more acoustic plates 316 is a suspended mass having relatively large surface areas. In one embodiment, said back acoustic plate 316*c* can comprise 16 square feet where said back acoustic plate 316*c* is four by four. Since the thickness of said one or more acoustic plates 316 can be modified at design time, various frequencies can be absorbed according to design parameters, to be discussed below.

In one embodiment, said one or more side supports 2202 can comprise strings, rubber bands, tape, and similar.

In one embodiment, said one or more acoustic plates 316 can comprise a plurality of said back acoustic plate 316*c* being attached with said one or more springs 2200 and said one or more side supports 2202.

FIG. 23 illustrates a suspended mass performance table 2300.

When using sound absorbing panels to absorb low frequency sounds such as those made by subwoofer's, the technology being used is generally badly designed. This is because the length of the soundwave is much longer for bass and low frequency sounds as compared to high frequency sounds.

So how thick must we design said one or more acoustic plates 316, and specifically said back acoustic plate 316*c* to effectively absorb said sound energy 1600? Thickness has its limits when designing sound panels. Sufficient thickness may be difficult to accommodate in a room and maybe an eyesore in these cases.

In one embodiment, said one or more acoustic plates 316 can be designed, as said back acoustic plate 316*c*, as a diaphragmatic barrier. Said suspended mass performance table 2300 presents the work of the applicant to absorb such bass sounds.

Herein, the term "high" and "low" frequencies relatively high and low as measured by the human ear. For example, the bottom three octaves of sound which are audible to the human ear, which are covered in said suspended mass performance table 2300, in the y-axis. Likewise, in the x-axis of said suspended mass performance table 2300, said one or more acoustic plates 316 start at ⅛" thickness on the left-hand side and as thin as possible on the right hand side.

An end user may desire to optimize his system for both higher and lower frequencies in which case the middle rows such as row 3-6 would be chosen.

One design technique here is to use a one inch by two inch weatherstripping is a baffle.

Here we want to add mass to the system which will help an absorbing base sounds. One approach is to use a block of wood, or plywood as discussed above. One advantage of wood is it allows more absorption and can wiggle or move which further adds to the absorption of sound.

One design technique is to continually make the wood thinner to absorb more sound.

Another approach is to mount two diaphragms on a spin table or a turntable. This double diaphragm design works like a drum. Recall that a drum has a battering head on its top and allows for the lower head in the upper head to sustain sounds as between them.

For example, said one or more acoustic plates 316 can be arranged in parallel in said frame 308 to create double diaphragm system. One advantage of this is to add mass at both ends and then increase the thickness of the membrane.

Figure 24A:
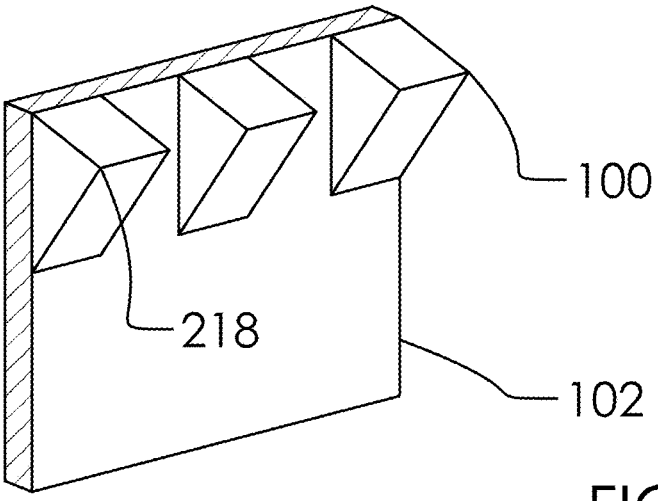
FIGS. 24A, 24B, and 24C illustrate an elevated overview of a plurality of said absorbing system 100 installed on said wall 102 and covered by a wall cover 2400.
Figure 24B:
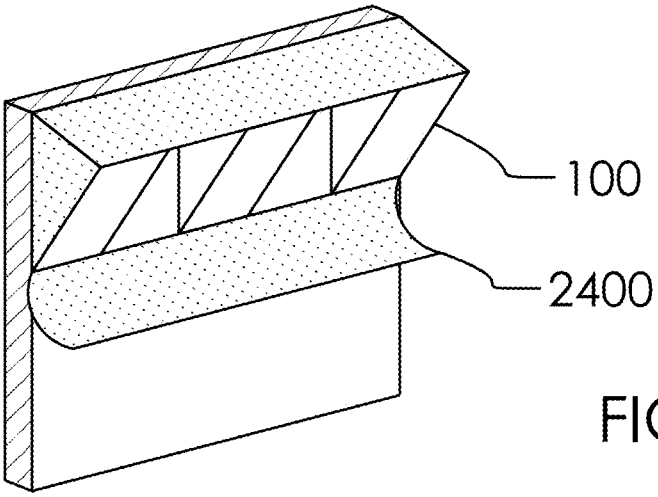
Figure 24C:
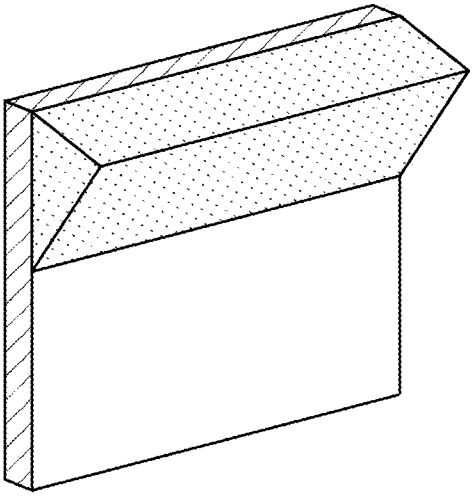

FIGS. 24A, 24B, and 24C illustrate an elevated overview of a plurality of said absorbing system 100 installed on said wall 102 and covered by a wall cover 2400.

In one embodiment, said absorbing system 100 can be installed on said wall 102 with said front corner angle 218 facing forward, toward said performance sound source 118. In another embodiment, said front corner angle 218 can be facing backward toward said wall 102, as illustrated below.

FIGS. 25A, 25B, 25C, and 25D illustrate said absorbing system 100 installed on said wall 102 with said front corner angle 218 facing away from said performance sound source 118.

Figure 25A:
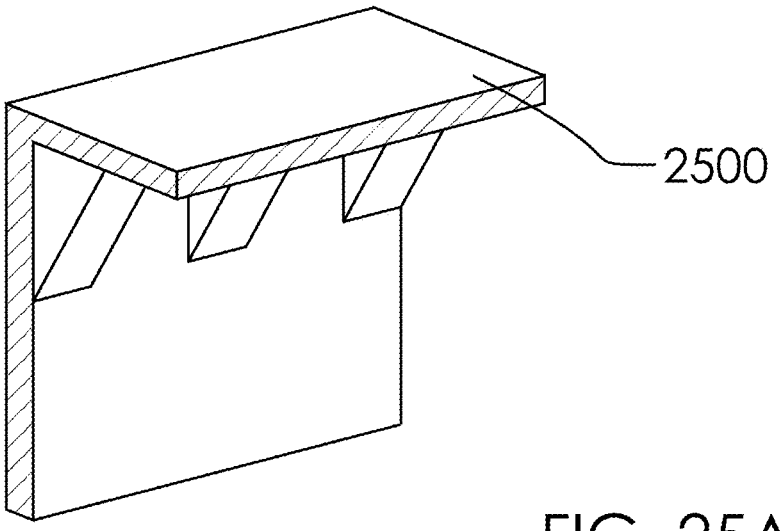
FIGS. 25A, 25B, 25C, and 25D illustrate said absorbing system 100 installed on said wall 102 with a front corner angle 218 facing away from a performance sound source 118.
Figure 25B:
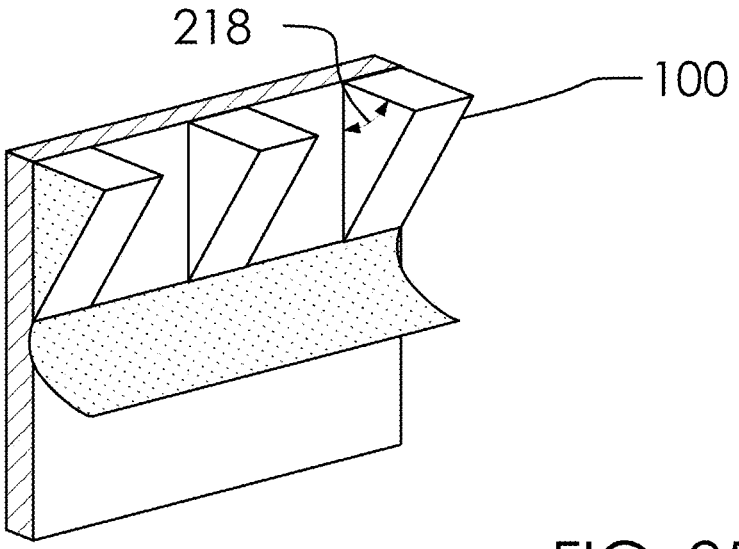
Figure 25C:
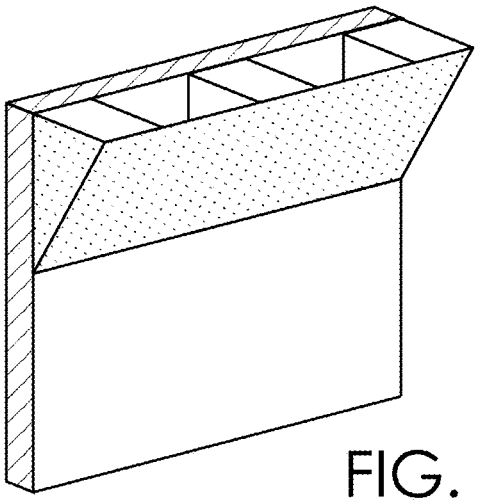
Figure 25D:
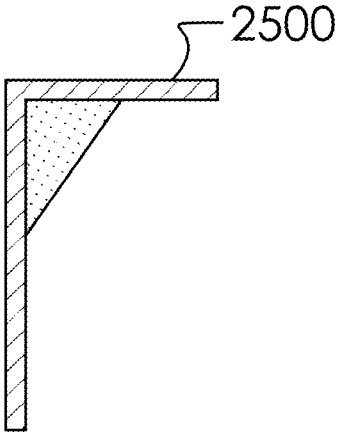

In one embodiment, said absorbing system 100 can be installed with said front corner angle 218 facing said wall 102. Wherein, said front corner angle 218 can comprise a right angle, and said absorbing system 100 can be configured to fit between said wall 102 and a ceiling 2500, as illustrated in FIG. 25D.

Figure 26:
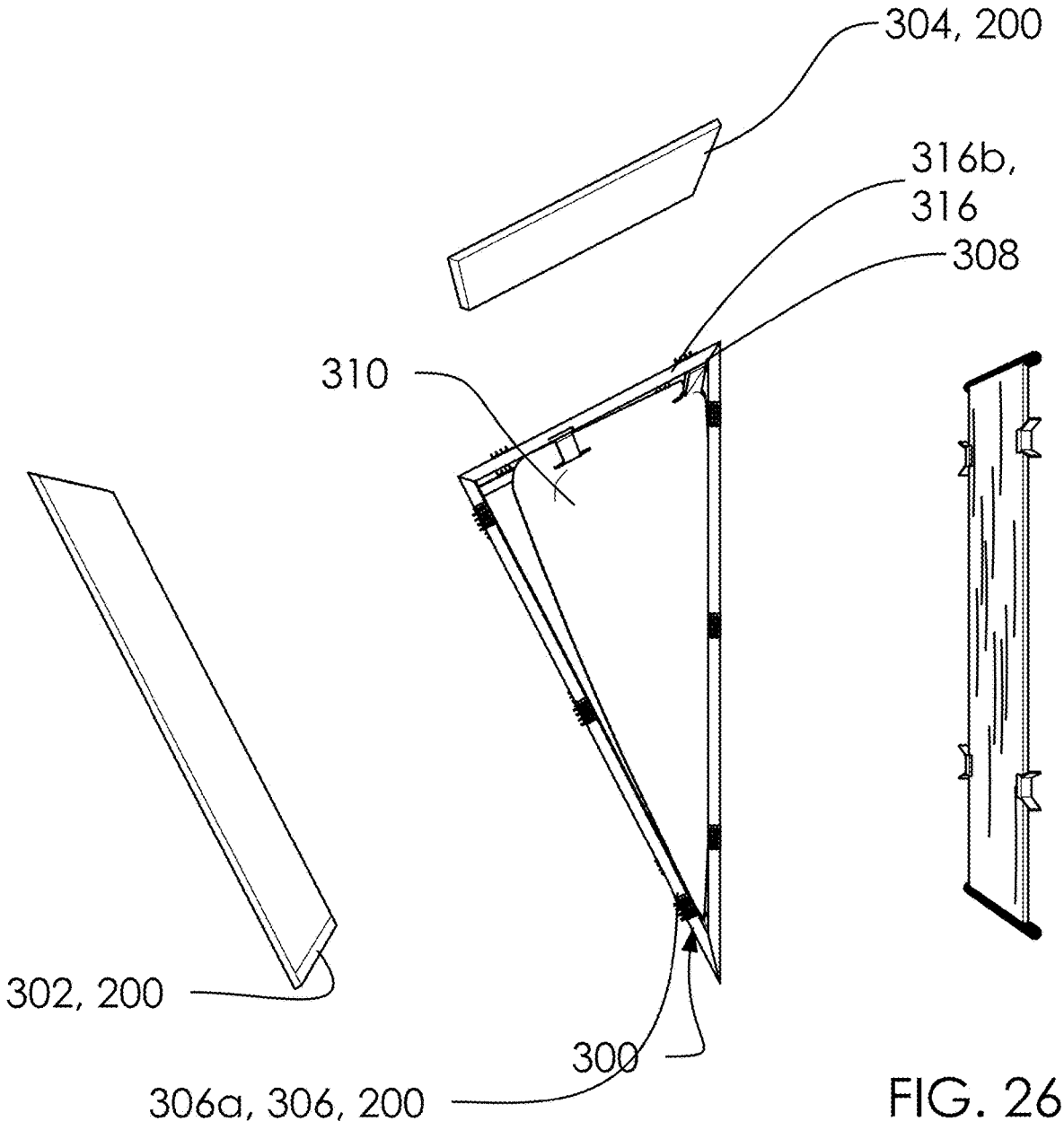
FIG. 26 illustrates a perspective side view of said absorbing system 100 in an exploded configuration, and without a portion of said one or more acoustic plates 316.

FIG. 26 illustrates a perspective side view of said absorbing system 100 in an exploded configuration, and without a portion of said one or more acoustic plates 316.

In one embodiment, said absorbing system 100 can be configured to absorb four segments of said sound energy 1600 which fall within the auditory range of a human ear. In one embodiment, said plurality of panels 200 can comprise a core material configured to absorb frequencies identified with tweeter speakers, a mat of said plurality of panels 200 can be configured to absorb and reduce frequencies by another octave, said suspended mass assembly 300 can be configured to absorb woofer range sounds, and said one or more acoustic plates 316 can be adapted to absorb subwoofer range sounds.

These parts are introduced in this specification:

said absorbing system 100,
said wall 102,
said block diagram 104,
said performance space 106,
said plurality of absorbing systems 108,
said side wall 110,
said rear wall 112,
said leading edge 114,
said trailing edge 116,
said performance sound source 118,
said plurality of panels 200,
said exterior sides 202,
said two side panels 204,
said first side panel 204*a*,
said second side panel 204*b*,
said upper front panel 206,
said lower front panel 208,
said width 210,
said height 212,
said upper panel length 214,
said lower panel length 216,
said front corner angle 218,
said open back side 220,
said panel thickness 222,
said suspended mass assembly 300,
said front panel 302,
said top panel 304, said two side panels 306,
said first side panel 306*a*,
said second side panel 306*b*,
said exterior frame 308,
said suspended absorbing mass 310,
said plurality of hanging straps 312,
said plurality of impaling clips 314,
said one or more acoustic plates 316,
said first acoustic plate 316*a*,
said second acoustic plate 316*b*,
said third acoustic plate 316*c*,
said first cut line 400*a*,
said second cut line 400*b*,
said third cut line 400*c*,
said fourth cut line 400*d*,
said fifth cut line 400*e*,
said plurality of strap hooks 500,
said first end 502,
said second end 504,
said bag strap 506,
said air gap 700,
said cover 702,
said absorptive portion 704,
said two vertical bars 1100,
said two rear horizontal bars 1102,
said front horizontal bar 1104,
said two hanging bars 1106,
said two lower side bars 1108,
said lower front frame 1300,
said one or more rear crossbars 1302,
said first rear crossbar 1302*a*,
said second rear crossbar 1302*b*,
said two horizontal bars 1400,
said vertical bar 1402,
said sound energy 1600,
said twisting motion 1602,
said vertical axis 1604,
said plurality of depths 1700,
said first depth 1700*a*,
said second depth 1700*b*,
said third depth 1700*c*,
said maximum depth 1702,
said top point 1704,
said bottom point 1706,
said minimum depth 1708,
said plurality of wavelengths 1800,
said first wavelength 1802*a*,
said second wavelength 1802*b*,
said wavelength data table 1804,
said wavelength data chart 1806,
said testing results chart and data table 1900,
said NRC results data table 1902,
said projected low frequency NRC 1904,
said one or more springs 2200,
said one or more side supports 2202,
said top end 2204,
said bottom end 2206,
said first side 2208,
said second side 2210,
said suspended mass performance table 2300,
said wall cover 2400, and
said ceiling 2500.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An absorbing system for disrupting short and long sound energy wavelengths, wherein:

said absorbing system comprises a frame, a plurality of hanging straps and a suspended absorbing mass;

said frame comprises a plurality of structural members comprising at least a two hanging bars;

said frame is arranged around said suspended absorbing mass with an air gap ensuring said suspended absorbing mass does not touch said frame and allowing said suspended absorbing mass to absorb a sound energy directed at said absorbing system;

said suspended absorbing mass hangs from said two hanging bars with said plurality of hanging straps;

said suspended absorbing mass comprises a cover and an absorptive portion;

said cover encases and holds said absorptive portion;

said suspended absorbing mass comprises a plurality of depths between a top point and a bottom point;

as arranged relative to an anticipated travel direction of said sound energy, said absorbing system comprises at least one tapered cross section with said plurality of depths comprise a minimum depth and tapering up to a maximum depth; and said maximum depth comprises a thickest portion of said suspended absorbing mass relative to said anticipated travel direction and is configured to absorb lower sound frequencies than said minimum depth.

2. The absorbing system of claim 1, wherein:

said absorptive portion comprises a substantially triangular cross section relative to said sound energy being directed at said absorbing system;

said plurality of depths comprise a full range of depths being incrementally represented within as between said minimum depth and said maximum depth; and said plurality of depths are linearly presented from said bottom point to said maximum depth, a smooth cancellation and disruption will occur across the generally accepted standard hearing range for humans of 20 to 20,000 Hz.

3. The absorbing system of claim 1, wherein:

said absorbing system comprises a plurality of panels attached to said frame; and said plurality of panels are arranged around an exterior sides of said absorbing system with said air gap keeping said suspended absorbing mass from touching said plurality of panels.

4. The absorbing system of claim 3, wherein:

said plurality of panels comprises at least a first side panel, and a second side panel, an upper front panel and a lower front panel.

5. The absorbing system of claim 4, wherein:

said absorbing system comprises a width, a height, an upper panel length, and a lower panel length; and said first side panel and said second side panel comprises a triangular shape with a front corner angle between said upper front panel and said lower front panel.

6. The absorbing system of claim 5, wherein:

said absorbing system is installed on a wall with said front corner angle facing forward, toward a performance sound source; and said front corner angle is facing backward toward said wall.

7. The absorbing system of claim 5, wherein:

said absorbing system is installed with said front corner angle facing said wall; and wherein, said front corner angle comprises a right angle, and said absorbing system is configured to fit between said wall and a ceiling.

8. The absorbing system of claim 5, wherein:

said front corner angle comprises a right angle; and said upper panel length and said lower panel length comprises legs and said height comprises a hypotenuse.

9. The absorbing system of claim 5, wherein:

said height comprises 9', said lower panel length comprises 8', said width comprises 4' and said upper panel length comprises about 4.1';

each of said plurality of panels comprises a panel thickness; and said panel thickness comprises 1~4 inches.

10. The absorbing system of claim 1, wherein:

said absorbing system further comprises one or more acoustic plates;

said one or more acoustic plates which comprises at least a front acoustic plate, a first side acoustic plate, and a back acoustic plate;

each among said one or more acoustic plates comprises an acoustic membrane positioned between said plurality of panels and said suspended absorbing mass; and said one or more acoustic plates fit within said frame.

11. The absorbing system of claim 10, wherein:

said one or more acoustic plates are suspended within a portion of said frame using one or more springs.

12. The absorbing system of claim 10, wherein:

said one or more acoustic plates comprises a material selected among: rubber, plywood, OSB, and plastic.

13. The absorbing system of claim 10, wherein:

said one or more acoustic plates have a thickness between 1/16th-1/4 inches.

14. The absorbing system of claim 10, wherein:

said front acoustic plate and said back acoustic plate are configured one in front of the other to create a substantially parallel dual membrane chamber with respect to said anticipated travel direction.

15. The absorbing system of claim 1, wherein:

said suspended absorbing mass is suspended from above with said plurality of hanging straps and is configured to freely twist in a twisting motion about a vertical axis; and said twisting motion allows said suspended absorbing mass to absorb said sound energy by allowing vibrations from said sound energy to be absorbed more freely into said suspended absorbing mass.

16. The absorbing system of claim 1, wherein:

said maximum depth comprises 25-35 inches to break up human audible low wavelengths; and since said plurality of depths are linearly presented from said bottom point to said maximum depth, a smooth cancellation and disruption will occur across the generally accepted standard hearing range for humans of 20 to 20,000 Hz.

17. The absorbing system of claim 1, wherein:

said absorbing system comprises said first side acoustic plate at a trailing edge relative to said anticipated travel direction; and whereby, said absorbing system is configured for a first reflection of said sound energy to enter said absorbing system at a side without said one or more acoustic plates then to penetrate all said suspended absorbing mass and said first side acoustic plate before exiting said absorbing system.

18. The absorbing system of claim 1, wherein:

said plurality of panels comprises a core material configured to absorb frequencies identified with tweeter speakers, a mat of said plurality of panels is configured to absorb and reduce frequencies by another octave, said suspended absorbing mass is configured to absorb woofer range sounds, and said one or more acoustic plates are adapted to absorb subwoofer range sounds.

19. An absorbing system for disrupting short and long sound energy wavelengths, wherein:

said absorbing system comprises a frame, a plurality of hanging straps and a suspended absorbing mass;

said frame comprises a plurality of structural members comprising at least a two hanging bars;

said frame is arranged around said suspended absorbing mass with an air gap ensuring said suspended absorbing mass does not touch said frame and allowing said suspended absorbing mass to absorb a sound energy directed at said absorbing system;

said suspended absorbing mass hangs from said two hanging bars with said plurality of hanging straps;

said suspended absorbing mass comprises a cover and an absorptive portion;

said cover encases and holds said absorptive portion;

said suspended absorbing mass comprises a plurality of depths between a top point and a bottom point;

as arranged relative to an anticipated travel direction of said sound energy, said absorbing system comprises at least one tapered cross section with said plurality of depths comprise a minimum depth and a maximum depth;

said maximum depth comprises a thickest portion of said suspended absorbing mass relative to said anticipated travel direction and is configured to absorb lower sound frequencies than said minimum depth;

said absorbing system comprises a plurality of panels attached to said frame;

said plurality of panels are arranged around an exterior sides of said absorbing system with said air gap keeping said suspended absorbing mass from touching said plurality of panels;

said absorbing system further comprises one or more acoustic plates;

said one or more acoustic plates which comprises at least a front acoustic plate, a first side acoustic plate, and a back acoustic plate;

each among said one or more acoustic plates comprises an acoustic membrane positioned between said plurality of panels and said suspended absorbing mass;

said one or more acoustic plates fit within said frame;

said maximum depth comprises 25-35 inches to break up human audible low wavelengths;

since said plurality of depths are linearly presented from said bottom point to said maximum depth, a smooth cancellation and disruption will occur across the generally accepted standard hearing range for humans of 20 to 20,000 Hz; and said plurality of panels comprises a core material configured to absorb frequencies identified with tweeter speakers, a mat of said plurality of panels is configured to absorb and reduce frequencies by another octave, said suspended absorbing mass is configured to absorb woofer range sounds, and said one or more acoustic plates are adapted to absorb subwoofer range sounds.

20. An absorbing system for disrupting short and long sound energy wavelengths, wherein:

said absorbing system comprises a frame, a plurality of hanging straps and a suspended absorbing mass;

said frame comprises a plurality of structural members comprising at least a two hanging bars;

said frame is arranged around said suspended absorbing mass with an air gap ensuring said suspended absorbing mass does not touch said frame and allowing said suspended absorbing mass to absorb a sound energy directed at said absorbing system;

said suspended absorbing mass hangs from said two hanging bars with said plurality of hanging straps;

said suspended absorbing mass comprises a cover and an absorptive portion;

said cover encases and holds said absorptive portion;

said suspended absorbing mass comprises a plurality of depths between a top point and a bottom point;

as arranged relative to an anticipated travel direction of said sound energy, said absorbing system comprises at least one tapered cross section with said plurality of depths comprise a minimum depth and a maximum depth;

said maximum depth comprises a thickest portion of said suspended absorbing mass relative to said anticipated travel direction and is configured to absorb lower sound frequencies than said minimum depth;

a plurality of panels comprises at least a first side panel, and a second side panel, an upper front panel and a lower front panel;

said absorbing system comprises a width, a height, an upper panel length, and a lower panel length;

said first side panel and said second side panel comprises a triangular shape with a front corner angle between said upper front panel and said lower front panel;

said height comprises 9', said lower panel length comprises 8', said width comprises 4' and said upper panel length comprises about 4.1';

each of said plurality of panels comprises a panel thickness; and said panel thickness comprises 1-4 inches.

* * * * *